US011749933B2

(12) United States Patent
Kobayashi et al.

(10) Patent No.: US 11,749,933 B2
(45) Date of Patent: Sep. 5, 2023

(54) CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Hiroki Kobayashi, Mie (JP); Hajime Kawase, Mie (JP); Masaaki Tabata, Mie (JP); Teruo Hara, Mie (JP); Hajime Matsui, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 135 days.

(21) Appl. No.: 17/601,683

(22) PCT Filed: Apr. 9, 2020

(86) PCT No.: PCT/JP2020/016052
§ 371 (c)(1),
(2) Date: Oct. 5, 2021

(87) PCT Pub. No.: WO2020/209348
PCT Pub. Date: Oct. 15, 2020

(65) Prior Publication Data

US 2022/0166159 A1 May 26, 2022

(30) Foreign Application Priority Data

Apr. 10, 2019 (JP) ..... 2019-074918

(51) Int. Cl.
*H01R 13/514* (2006.01)
*H01R 13/436* (2006.01)
(Continued)

(52) U.S. Cl.
CPC ..... *H01R 13/514* (2013.01); *H01R 13/4364* (2013.01); *H01R 13/5213* (2013.01); *H01R 13/58* (2013.01)

(58) Field of Classification Search
CPC ..... H01R 13/514; H01R 13/4364; H01R 13/5213; H01R 13/58; H01R 13/5833
See application file for complete search history.

(56) References Cited

U.S. PATENT DOCUMENTS 4,195,898 A * 4/1980 Chow ..... H01R 13/58 439/407
5,427,544 A * 6/1995 Okabe ..... H01R 4/2466 439/942
(Continued)

FOREIGN PATENT DOCUMENTS

JP H02-009499 Y2 3/1990
JP H10-261471 A 9/1998
(Continued)

OTHER PUBLICATIONS

International Search Report dated Jun. 23, 2020 for WO 2020/209348 A1 (6 pages).

*Primary Examiner* — Tho D Ta
(74) *Attorney, Agent, or Firm* — Venjuris, P.C.

(57) ABSTRACT

A joint connector 10 to be connected to wires 11 includes a lower housing 30 and an upper cover 60. The lower housing 30 accommodates terminals 12 to be respectively connected to front end parts in an extending direction of the wires 11. The upper cover 60 is assembled to close an upper surface of the lower housing 30. The lower housing 30 or the upper cover 60 includes a lower guide portion 36 or an upper guide
(Continued)

portion 69 for bending the wires 11 by contacting the wires 11 with the lower housing 30 and the upper cover 60 assembled.

10 Claims, 29 Drawing Sheets

(51) Int. Cl.
*H01R 13/52* (2006.01)
*H01R 13/58* (2006.01)

(56) References Cited

U.S. PATENT DOCUMENTS 5,620,346 A * 4/1997 Okumura ..... G01R 31/69 439/752
5,624,273 A * 4/1997 Myer ..... H01R 13/58 439/852
5,716,242 A * 2/1998 Myer ..... H01R 4/2466 439/748
6,280,262 B1 * 8/2001 Tanaka ..... H01R 13/4362 439/752
6,332,814 B2 * 12/2001 Sato ..... H01R 13/415 439/741
6,402,573 B1 * 6/2002 Yeomans ..... H01R 13/4362 439/752
2002/0119710 A1 8/2002 Mello et al.
2003/0104732 A1 6/2003 Ferderer

FOREIGN PATENT DOCUMENTS

JP H11-191442 A 7/1999
JP 2007-141725 A 6/2007
JP 2009-064679 A 3/2009
JP 2011-187377 A 9/2011
JP 2015-022968 A 2/2015

* cited by examiner

CONNECTOR

CROSS REFERENCE TO RELATED APPLICATIONS

This application is a national phase of PCT application No. PCT/JP2020/016052, filed on 9 Apr. 2020, which claims priority from Japanese patent application No. 2019-074918, filed on 10 Apr. 2019, all of which are incorporated herein by reference.

TECHNICAL FIELD

The present disclosure relates to a connector.

BACKGROUND

A joint connector described in Japanese Patent Laid-Open Publication No. H10-261471 is known as a conventional connector. In this joint connector, a retainer body of a busbar-equipped retainer is fittably provided at terminal insertion openings of respective terminal accommodation chambers of a housing, the retainer body is provided with locking portions to be locked to engaging portions provided at the terminal insertion openings of the respective terminal accommodation chambers, and terminals of a busbar of the busbar-equipped retainer are lockable to locking portions of a joint terminal. Further, a retainer body of a retainer having the same shape as the busbar-equipped retainer is fittably provided at the terminal insertion openings of the respective terminal accommodation chambers of each housing.

PRIOR ART DOCUMENT

Patent Document

Patent Document 1: JP H10-261471 A

SUMMARY OF THE INVENTION

Problems to be Solved

Recently, miniaturization has been required for connectors to be equipped in vehicles. As a housing of a connector is reduced in size, the miniaturization of a component (e.g. retainer) for locking terminals is also considered. Then, the strength of the component for locking the terminals may be reduced. In this way, the terminals are not firmly locked in the housing, with the result that there is a concern that the terminals and the housing rattle due to an external force transmitted to the terminals via wires. Further, if the terminals are reduced in size, the strength of the terminals themselves is also reduced. Thus, troubles of the terminals themselves may be caused by the external force applied via the wires.

The present disclosure was completed on the basis of the above situation and aims to provide a connector capable of suppressing the transmission of an external force from wires to terminals.

Means to Solve the Problem

The present disclosure is directed to a connector to be connected to wires, the connector including a lower housing and an upper cover, wherein the lower housing accommodates terminals to be respectively connected to front end parts in an extending direction of the wires, the upper cover is assembled to close an upper surface of the lower housing, and the lower housing or the upper cover include a guide portion for bending the wires by contacting the wires with the lower housing and the upper cover assembled.

Effect of the Invention

According to the present disclosure, it is possible to suppress the transmission of an external force from wires to terminals in a connector.

DETAILED DESCRIPTION TO EXECUTE THE INVENTION

Description of Embodiments of Present Disclosure

Figure 1:
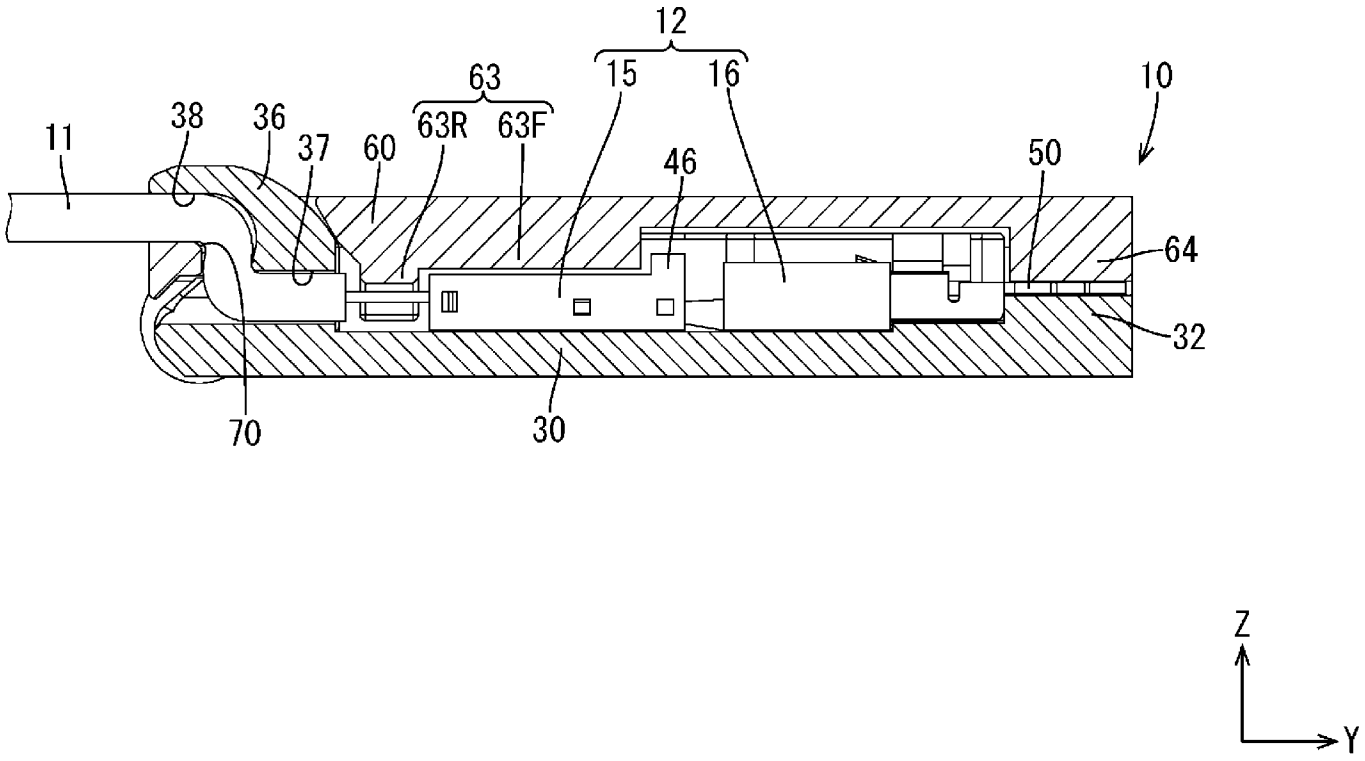
FIG. 1 is a section showing a joint connector according to a first embodiment.

First, embodiments of the present disclosure are listed and described.

(1) The present disclosure is directed to a connector to be connected to wires, the connector including a lower housing and an upper cover, wherein the lower housing accommodates terminals to be respectively connected to front end parts in an extending direction of the wires, the upper cover is assembled to close an upper surface of the lower housing, and the lower housing or the upper cover include a guide portion for bending the wires by contacting the wires with the lower housing and the upper cover assembled.

If an external force is applied to the wires, this external force is transmitted to the connector along the wires. Since the force transmitted to the wires is absorbed in bent parts of the wires, the transmission of the force applied to the wires to the inside of the connector is suppressed.

(2) The upper cover is so assembled with the lower housing as to be rotatable between an opening position for opening the upper surface of the lower housing and a closing position for closing the upper surface of the lower housing, and the guide portion contacts and bends the wires at the closing position.

Since a step of rotating the upper cover from the opening position to the closing position and a step of bending the wires can be performed in one step, a manufacturing process of the connector can be made efficient.

(3) Preferably, the upper cover is so assembled with the lower housing as to be movable along the extending direction between a temporary closing position for closing a part of the upper surface of the lower housing and the closing position.

The wires can be held in a bent state by moving the upper cover from the temporary closing position to the closing position. In this way, the transmission of an external force applied to the wires to the inside of the connector can be more suppressed.

(4) Preferably, one of the upper cover and the lower housing includes a shaft portion projecting toward the other and the other includes a shaft hole to be engaged with the shaft portion, the shaft hole includes a rotating portion to be relatively rotatably engaged with the shaft portion and an extending portion extending from the rotating portion, and the extending portion extends along the extending direction with the upper cover disposed at the temporary closing position with respect to the lower housing.

The upper cover can be easily moved from the temporary closing position to the closing position by moving the shaft portion along the extending direction in the extending portion after rotating the upper cover from the opening position to the temporary closing position with the shaft portion engaged with the rotating portion of the shaft hole.

(5) Preferably, a lock portion provided on one of the upper cover and the lower housing is locked to the other of the upper cover and the lower housing, whereby the upper cover is assembled at the closing position with the lower housing, the guide portion is provided near an axis of rotation, the upper cover rotating about the axis of rotation with respect to the lower housing, and the lock portion is provided at a position distant from the axis of rotation.

The guide portion for bending the wires is provided near the axis of rotation, whereas a configuration for locking the upper cover and the lower housing is distant from the axis of rotation. Thus, a load in locking the upper cover and the lower housing can be efficiently utilized as a force for bending the wires by the principle of leverage. In this way, the wires can be bent.

(6) Preferably, the guide portion includes a lower guide portion provided on the lower housing and an upper guide portion provided on the upper cover, and an upper surface of the lower guide portion has a shape along a trajectory of the upper cover moving between the opening position and the closing position.

In this way, the contact of the upper cover and an upper part of the lower guide portion can be suppressed when the upper cover is rotated with respect to the lower housing.

(7) Preferably, the guide portion includes a lower guide portion provided on the lower housing and an upper guide portion provided on the upper cover, the lower guide portion includes a lower contact portion for bending the wires by contacting the wires, and the upper guide portion includes an upper contact portion for bending the wires by contacting the wires.

Since the wires are in contact with both the upper contact portion of the upper cover and the lower contact portion of the lower housing, a force applied to the wires can be received by both the upper cover and the lower housing. In this way, the transmission of the force applied to the wires to the terminals can be more suppressed.

Preferably, the lower housing includes a positioning portion for positioning the wires by contacting the wires.

The wires are positioned in the lower housing by the positioning portion provided in the lower housing. In this way, the bent parts of the wires can be precisely positioned.

(9) Preferably, a busbar is provided which is to be connected to a plurality of the terminals, the busbar includes a plurality of tabs and a coupling portion coupling the plurality of tabs, each of the plurality of terminals includes a busbar connecting portion to be connected to one of the plurality of tabs, a sandwiching portion extending along the extending direction and configured to sandwich the wire and a slide portion disposed outside the sandwiching portion and movable along the extending direction, and the slide portion includes a pressurizing portion for pressurizing the sandwiching portion toward the wire with the wire sandwiched by the sandwiching portion.

According to the above configuration, the connector according to the present disclosure can be applied to a joint connector for connecting a plurality of wires.

Further, since the wire and the terminal are connected by the sandwiching portion being pressed by the pressurizing portion, dies necessary in crimping a barrel to the outer periphery of the wire becomes unnecessary and the manufacturing cost of the joint connector can be reduced.

(10) Preferably, the upper cover or the lower housing includes insertion holes in a part where the terminals are to be disposed, mating terminals being inserted into the insertion holes.

According to the above configuration, the present disclosure can be applied to a female connector.

(11) Preferably, the upper cover includes terminal engaging portions to be engaged with the terminals with the upper cover assembled with the lower housing.

Since movements of the terminals can be suppressed by the terminal engaging portions engaged with the terminals, the terminals can be held in the lower housing.

(12) Preferably, the terminal includes a wire connecting portion to be connected to the wire and a slide portion, each wire connecting portion includes a sandwiching portion extending along the extending direction and configured to sandwich the wire, the slide portion is disposed outside the sandwiching portion and movable along the extending direction between a full locking position and a partial locking position different from the full locking position, the slide portion includes a pressurizing portion for pressurizing the sandwiching portion toward the wire with the wire sandwiched by the sandwiching portion when the slide portion moves to the full locking position, and the upper cover includes terminal engaging portions to be engaged with the terminals having the slide portions disposed at the full locking position.

By assembling the upper cover with the lower housing, the terminal engaging portions of the upper cover are engaged with the terminals having the slide portions moved to the full locking position. In this way, whether or not the slide portions have moved to the full locking position in the terminals can be detected.

DETAILS OF EMBODIMENT OF PRESENT DISCLOSURE

Hereinafter, embodiments of the present disclosure are described. The present invention is not limited to these illustrations and is intended to be represented by claims and include all changes in the scope of claims and in the meaning and scope of equivalents.

First Embodiment

A first embodiment of the present disclosure is described with reference to FIGS. 1 to 15. A joint connector 10 (an example of a connector) according to this embodiment electrically connects a plurality of wires 11. In the following description, a direction indicated by an arrow Z is an upward direction, a direction indicated by an arrow Y is a forward direction and a direction indicated by an arrow X is a leftward direction. Note that, for a plurality of identical members, only some may be denoted by a reference sign and the others may not be denoted by the reference sign.

[Joint Connector 10]

Figure 2:
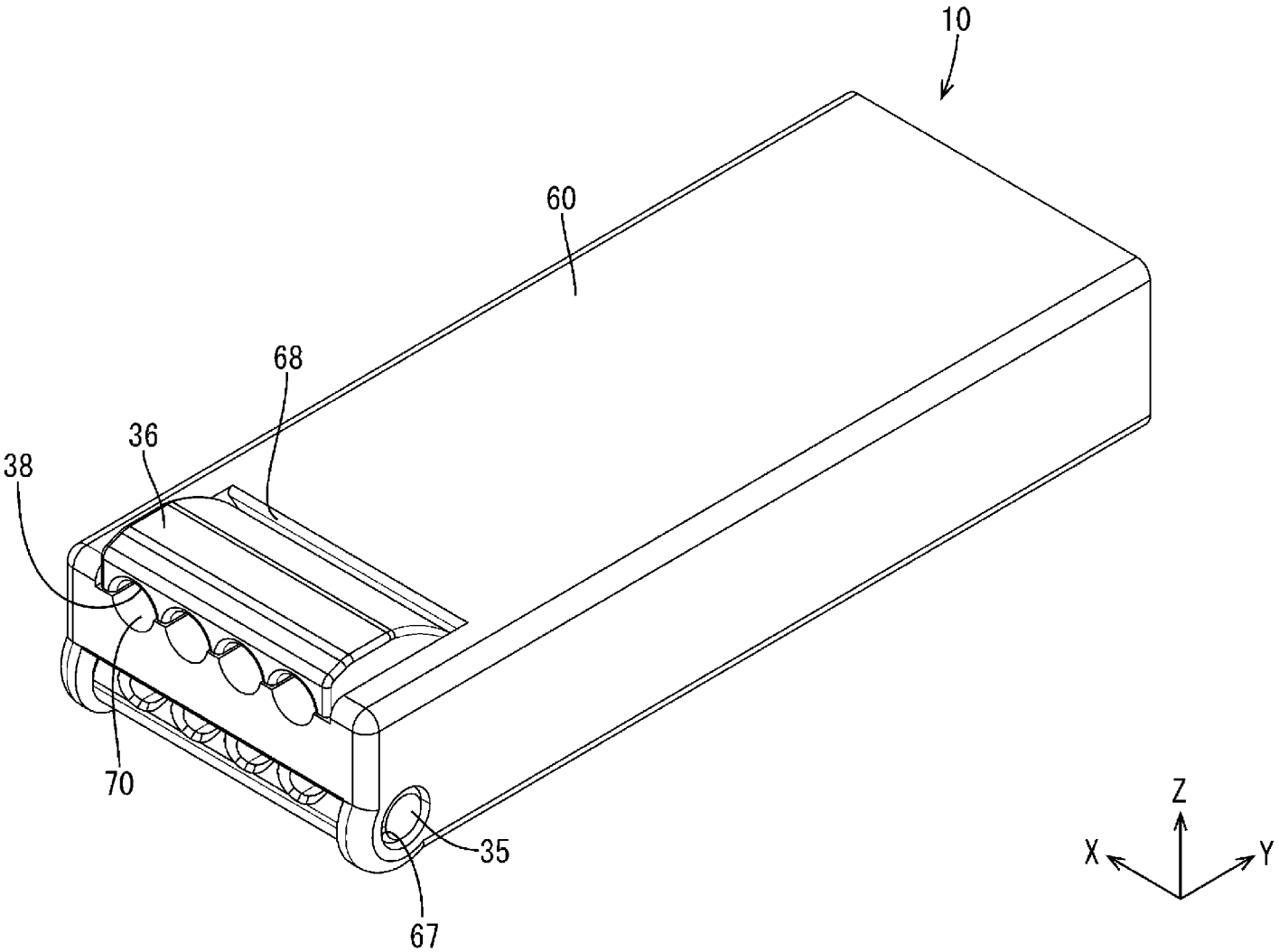
FIG. 2 is a perspective view showing the joint connector.
Figure 3:
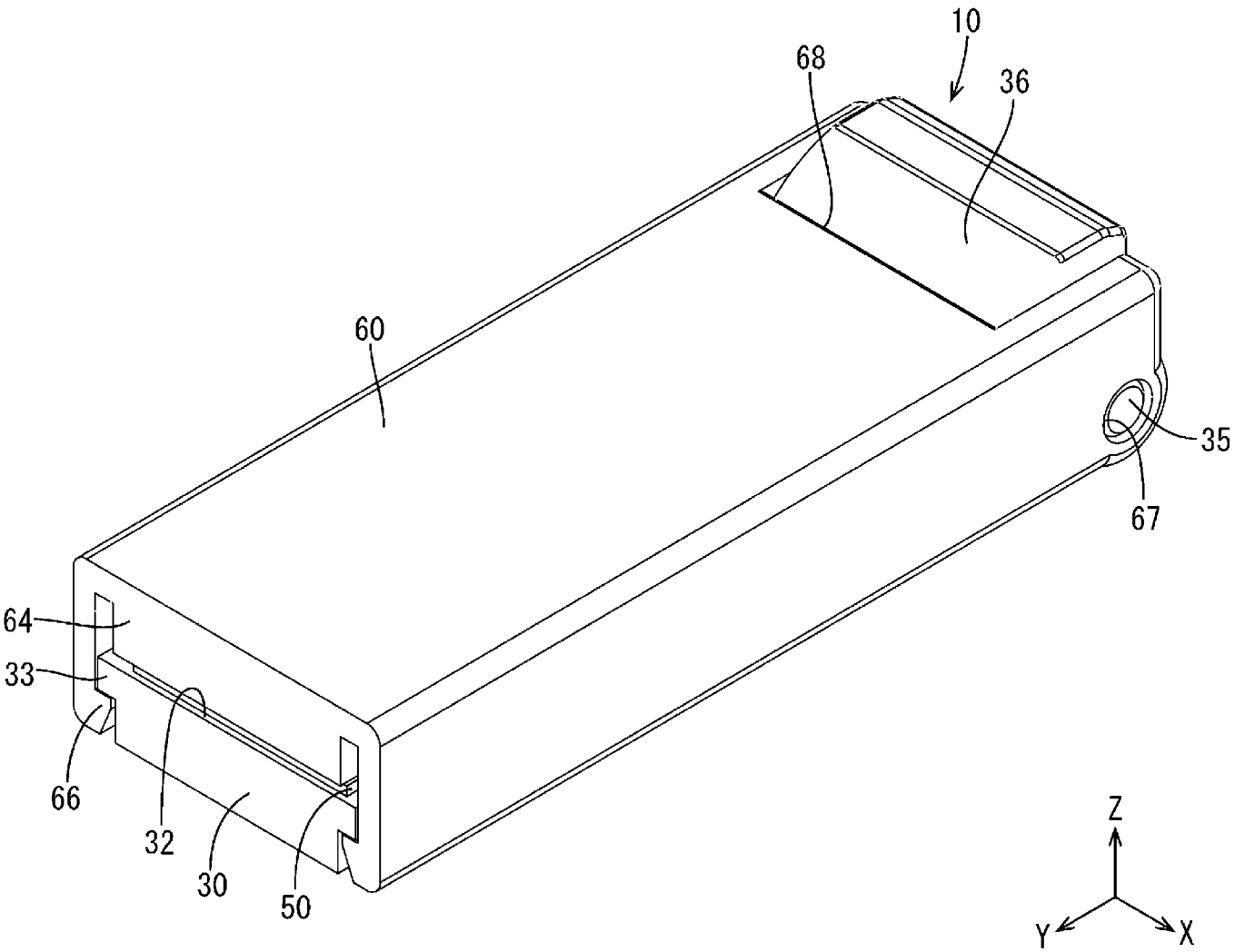
FIG. 3 is a perspective view showing the joint connector.

As shown in FIG. 1, the joint connector 10 according to this embodiment includes a plurality of terminals 12 to be respectively connected to front end parts of the plurality of wires 11 in a front-rear direction (an example of an extending direction), a busbar 50 to be connected to the plurality of terminals 12, a lower housing 30 for accommodating the plurality of terminals 12 and the busbar 50 inside, and an upper cover 60 to be mounted on an upper-rear part of the lower housing 30. The wires 11 are routed to extend substantially in the front-rear direction, and the front-rear direction is defined as an extending direction of the wires 11. As shown in FIGS. 2 and 3, the joint connector 10 has a rectangular parallelepiped shape extending in the front-rear direction.

[Wires 11]

As shown in FIG. 1, the plurality of wires 11 are disposed to extend in the front-rear direction (an example of the extending direction). In the wire 11, the outer periphery of a core 13 is surrounded with an insulation coating 14 made of insulating synthetic resin. The core 13 according to this embodiment is composed of one metal wire. Note that the core 13 may be a stranded wire formed by twisting a plurality of metal thin wires. An arbitrary metal such as copper, copper alloy, aluminum or aluminum alloy can be appropriately selected as a metal constituting the core 13 if necessary. The core 13 according to this embodiment is made of copper or copper alloy.

[Lower Housing 30]

Figure 4:
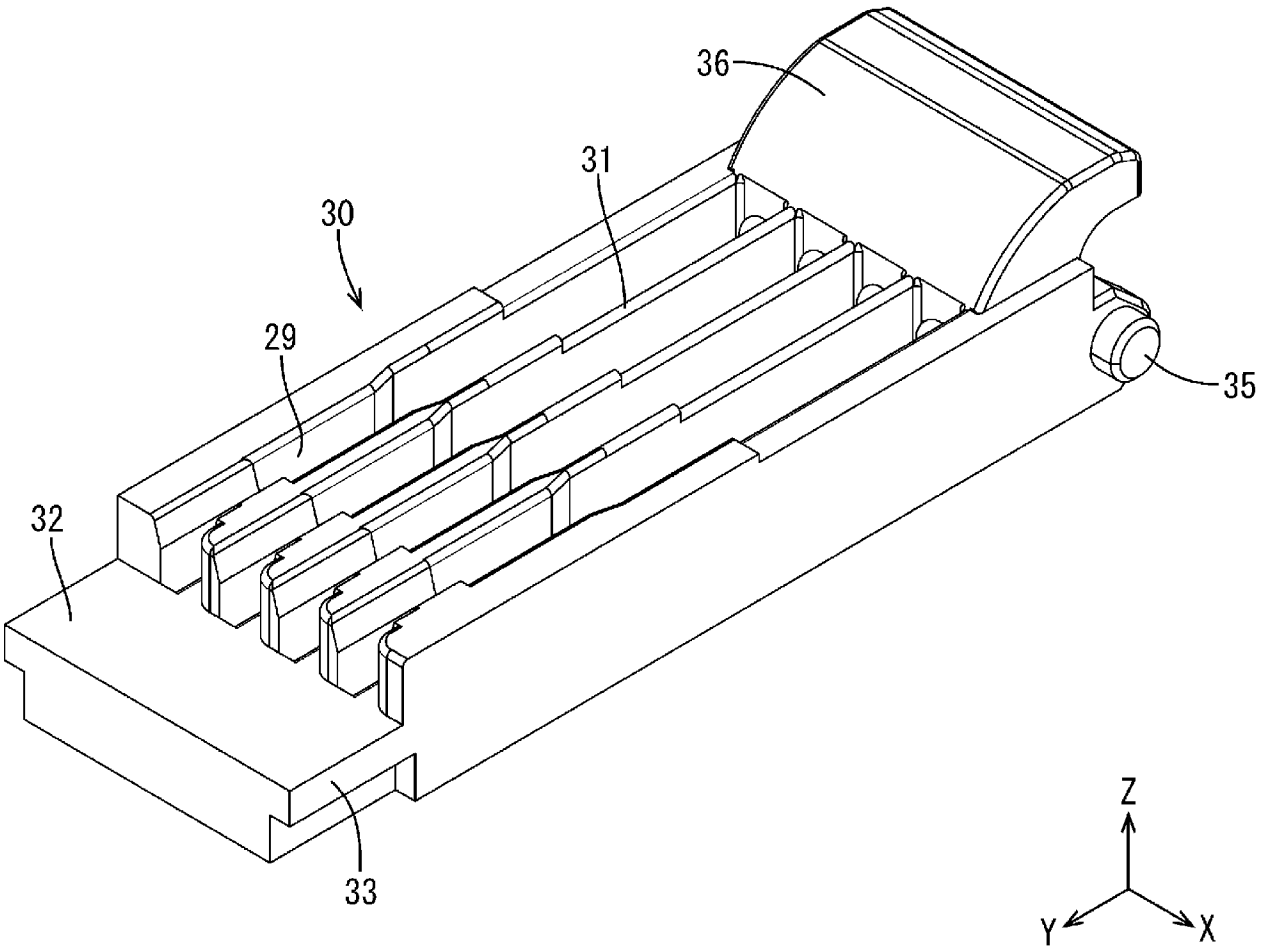
FIG. 4 is a perspective view showing a lower housing.

As shown in FIG. 4, the lower housing 30 is shaped to extend in the front-rear direction and be flat in a vertical direction. The lower housing 30 is formed by injection-molding a material containing an insulating synthetic resin. The lower housing 30 is formed with a plurality of (four in this embodiment) cavities 29 extending in the front-rear direction and arranged in a lateral direction. The cavities 29 are open upward and the terminals 12 are arranged into the cavities 29 from above. The cavities 29 adjacent in the lateral direction are partitioned by partition walls 31 extending in the front-rear direction. The terminals 12 arranged in the respective cavities 29 are electrically insulated by these partition walls 31.

As shown in FIG. 4, the cavities 29 are open forward in a front end part of the lower housing 30. A busbar placing portion 32 flush with the bottom walls of the cavities 29 and formed to extend in the lateral direction is formed in the front end part of the lower housing 30. The busbar 50 is placed on the busbar placing portion 32 from above.

Figure 5:
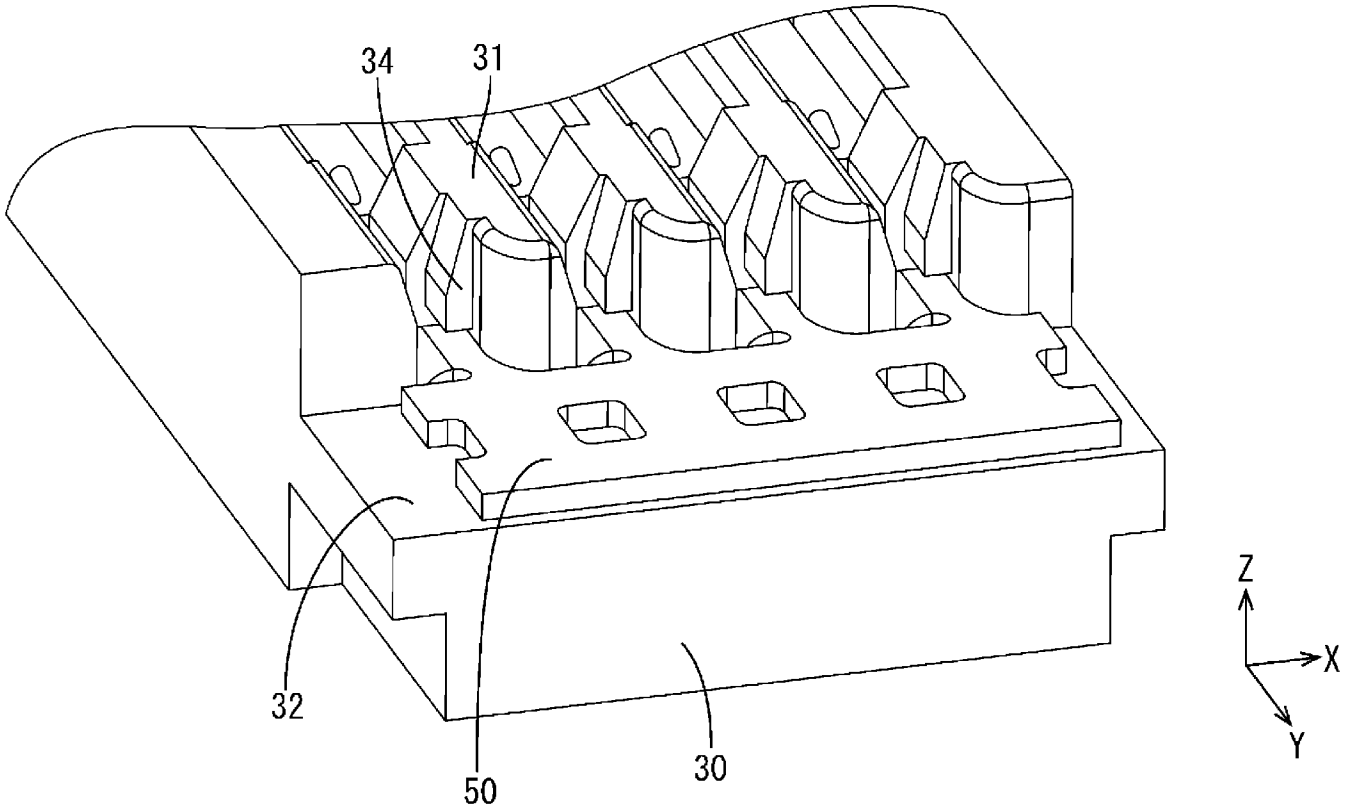
FIG. 5 is a partial enlarged perspective view showing a locking structure of a busbar and the lower housing.

As shown in FIG. 5, locking claws 34 for suppressing an upward movement of the busbar 50 by contacting the busbar 50 from above are formed on front end parts of the partition walls 31. Lower end parts of the locking claws 34 only have to contact the busbar 50 when the busbar 50 is moving upward and may be normally separated from the busbar 50.

As shown in FIG. 4, a shaft portion 35 projecting outward is formed at a position near a rear end part on each side wall of the lower housing 30. The shaft portion 35 has a cylindrical shape.

As shown in FIG. 4, a lower guide portion 36 (an example of a guide portion) is formed on a rear end part of the lower housing 30. The lower guide portion 36 is provided near the shaft portions 35 at a position above the shaft portions 35. As shown in FIG. 1, the lower guide portion 36 is formed with a plurality of (four in this embodiment) wire insertion holes 37 (an example of wire positioning portions) penetrating in the front-rear direction and arranged in the lateral direction. An inner diameter of the wire insertion hole 37 is equal to or larger than an outer diameter of the wire 11. The respective cavities 29 are located in front of the respective wire insertion holes 37. By being inserted into the respective wire insertion holes 37, the wires 11 are positioned with respect to the lower housing 30.

As shown in FIG. 1, a front half part of the lower guide portion 36 is formed into a curved surface from a front part to an upper part of the lower guide portion 36. A rear half part of the lower guide portion 36 is shaped to project rearward from the rear end of the lower housing 30. The upper surface of the rear half part of the lower guide portion 36 is a flat surface extending in the front-rear direction. The upper surface of the lower guide portion 36 is inclined downward in a rear end part of the lower guide portion 36.

As shown in FIG. 1, a region of the lower guide portion 36 behind a part formed with the wire insertion holes 37 serves as a lower contact portion 38 in the form of a curved surface concave upward. The lower contact portion 38 contacts upper parts of the wires 11 to arrange the wires 11 along the lower contact portion 38. The lower contact portion 38 is shaped to be concave to rise upward in rear openings of the wire insertion holes 37 and extend rearward while forming a gentle curve.

[Upper Cover 60]

Figure 6:
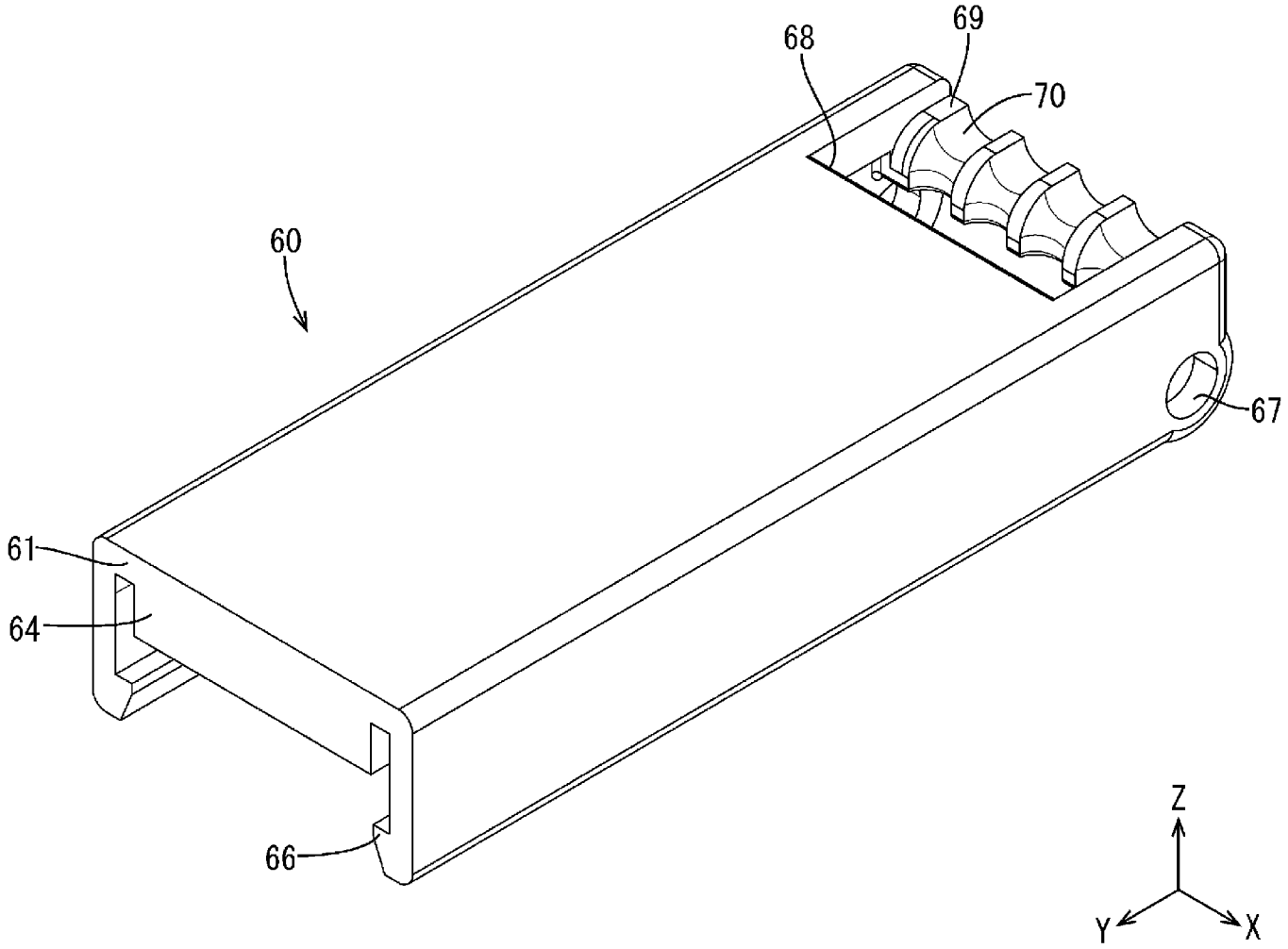
FIG. 6 is a perspective view showing an upper cover.

As shown in FIG. 1, the lower housing 30 has an upper part covered by the upper cover 60 assembled from above. The upper cover 60 is formed by injection-molding a material containing an insulating synthetic resin. As shown in FIG. 6, lock claws 66 (an example of a lock portion) are formed on front end parts of side walls of the upper cover 60. These lock claws 66 are resiliently engaged with lock receiving portions 33 provided on side walls of the lower housing 30, whereby the lower housing 30 and the upper cover 60 are integrally assembled.

As shown in FIG. 6, shaft holes 67 to be fit to the shaft portions 35 of the lower housing 30 are formed in a rear end part of the upper cover 60. By fitting the shaft holes 67 to the shaft portions 35, the upper cover 60 is so assembled with the lower housing 30 as to be rotatable with the shaft portions 35 as an axis of rotation.

Figure 14:
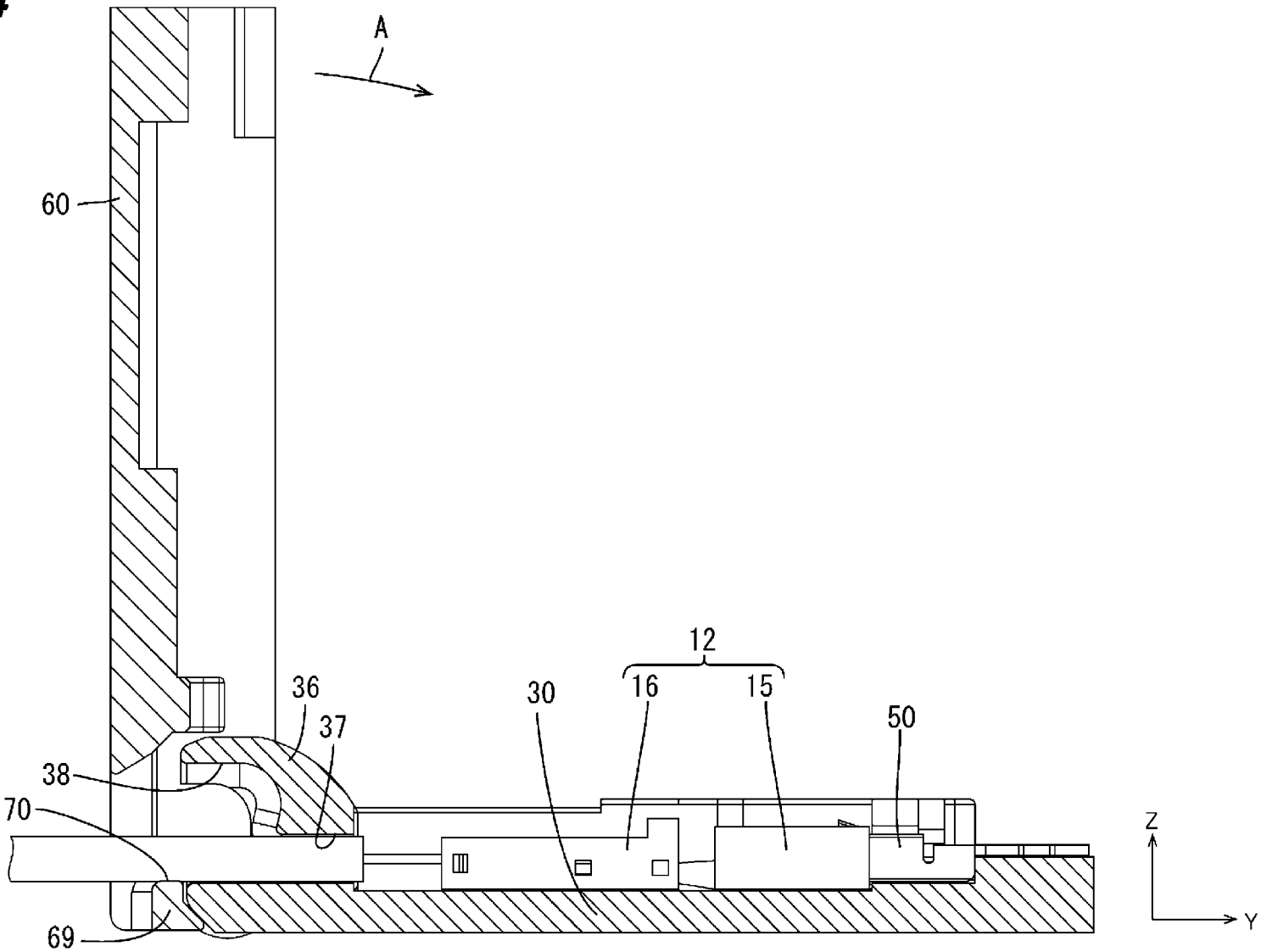
FIG. 14 is a section showing a state where an upper cover is assembled at an opening position.

The upper cover 60 is rotatable between an opening position where the upper cover 60 is assembled with the lower housing 30 with the upper surface of the lower housing 30 opened as shown in FIG. 14 and a closing position where the upper surface of the lower housing 30 is closed as shown in FIG. 1.

As shown in FIG. 1, with the lower housing 30 and the upper cover 60 assembled, a front end part of an upper wall 61 of the upper cover 60 is formed with a busbar holding portion 64 projecting downward at a position corresponding to the busbar placing portion 32 of the lower housing 30. The busbar 50 is sandwiched between the busbar holding portion 64 and the busbar placing portion 32 of the lower housing 30. In this way, the busbar 50 is held in the lower housing 30 and the upper cover 60.

Figure 7:
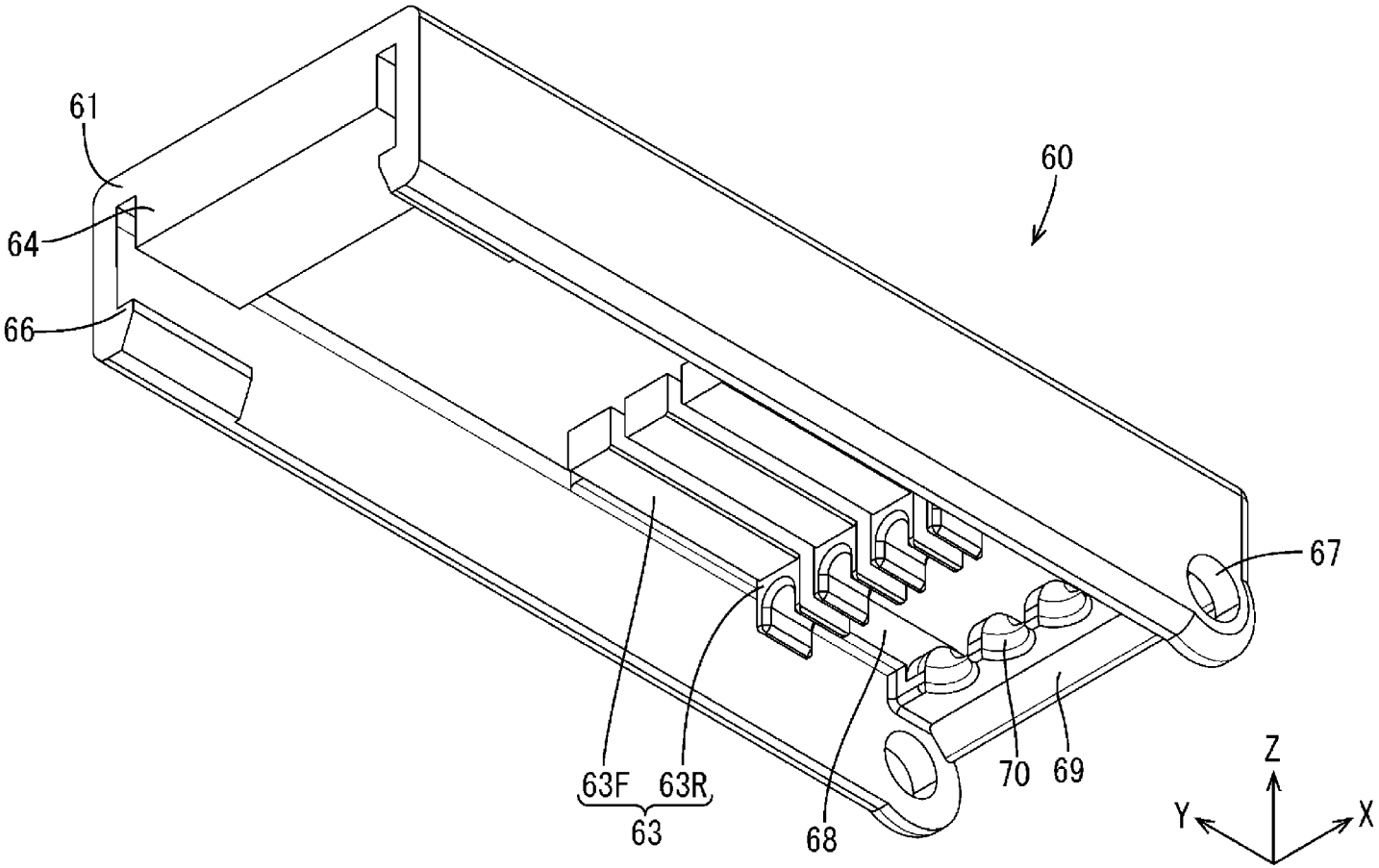
FIG. 7 is a perspective view showing the upper cover.

As shown in FIG. 7, with the lower housing 30 and the upper cover 60 assembled, the upper wall 61 is provided with a plurality of (four in this embodiment) terminal engaging portions 63 projecting downward and extending in the front-rear direction at positions behind the busbar holding portion 64. The terminal engaging portion 63 includes a front terminal engaging portion 63F located on a front side and a rear terminal engaging portion 63R located behind the front terminal engaging portion 63F. The rear terminal engaging portion 63R projects more downward than the front terminal engaging portion 63F. The lower surface of the rear terminal engaging portion 63R is formed into a groove concave upward, so that each wire 11 is fit thereinto.

As shown in FIG. 7, an opening 68, through which the wires are drawn out, is open upward in a rear end part of the upper wall 61 of the upper cover 60. An upper guide portion 69 (an example of a guide portion) bridged in the lateral direction in the opening 68 is formed in the rear end part of the upper cover 60. The upper guide portion 69 is provided near the shaft holes 67 at a position above the shaft holes 67. An upper contact portion 70 is formed on the front and upper surfaces of the upper guide portion 69. The lower surfaces of the wires 11 contact the upper contact portion 70 to be arranged along the upper contact portion 70. The upper contact portion 70 is formed by arranging a plurality of (four in this embodiment) U-shaped grooves. The respective wires 11 are accommodated in groove-like parts.

A part of the lower guide portion 36 from the upper surface to the front surface has a shape along a trajectory of a front end part of the opening 68 of the upper cover 60 moving from the opening position to the closing position. In this way, when the upper cover 60 moves from the opening position to the closing position, the interference of the upper cover 60 and the lower housing 30 can be suppressed.

[Busbar 50]

Figure 8:
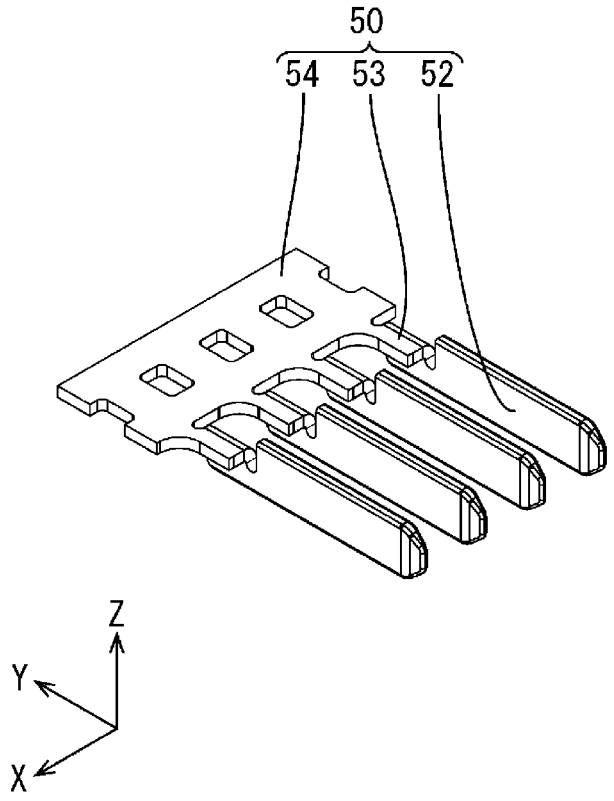
FIG. 8 is a perspective view showing the busbar.

As shown in FIG. 8, the busbar 50 is formed by press-working a metal plate material into a predetermined shape. An arbitrary metal such as copper or copper alloy can be appropriately selected as the metal plate material. The busbar 50 includes a plurality of (four in this embodiment) tabs 52 extending rearward and a coupling portion 54 coupling front end parts of the tabs 52 via relay portions 53. The tab 52 is in the form of a plate flat in the lateral direction. The coupling portion 54 is in the form of a plate flat in the vertical direction. The relay portions 53 are formed to extend rearward from the coupling portion 54. The right side edge of the relay portion 53 is bent downward and connected to the tab 52.

Figure 11:
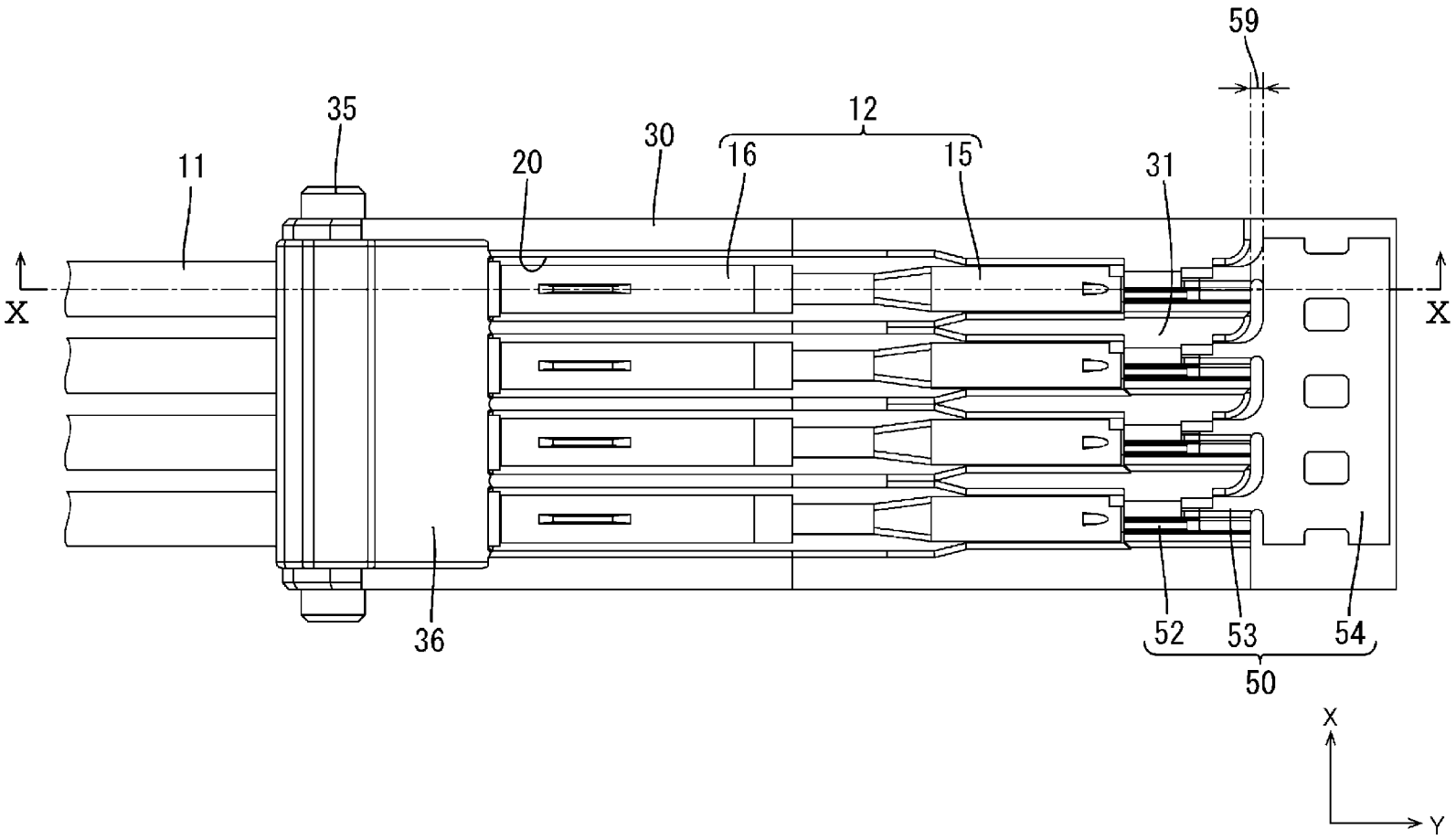
FIG. 11 is a plan view showing a state where the terminals and the busbar are accommodated in the lower housing.
Figure 12:
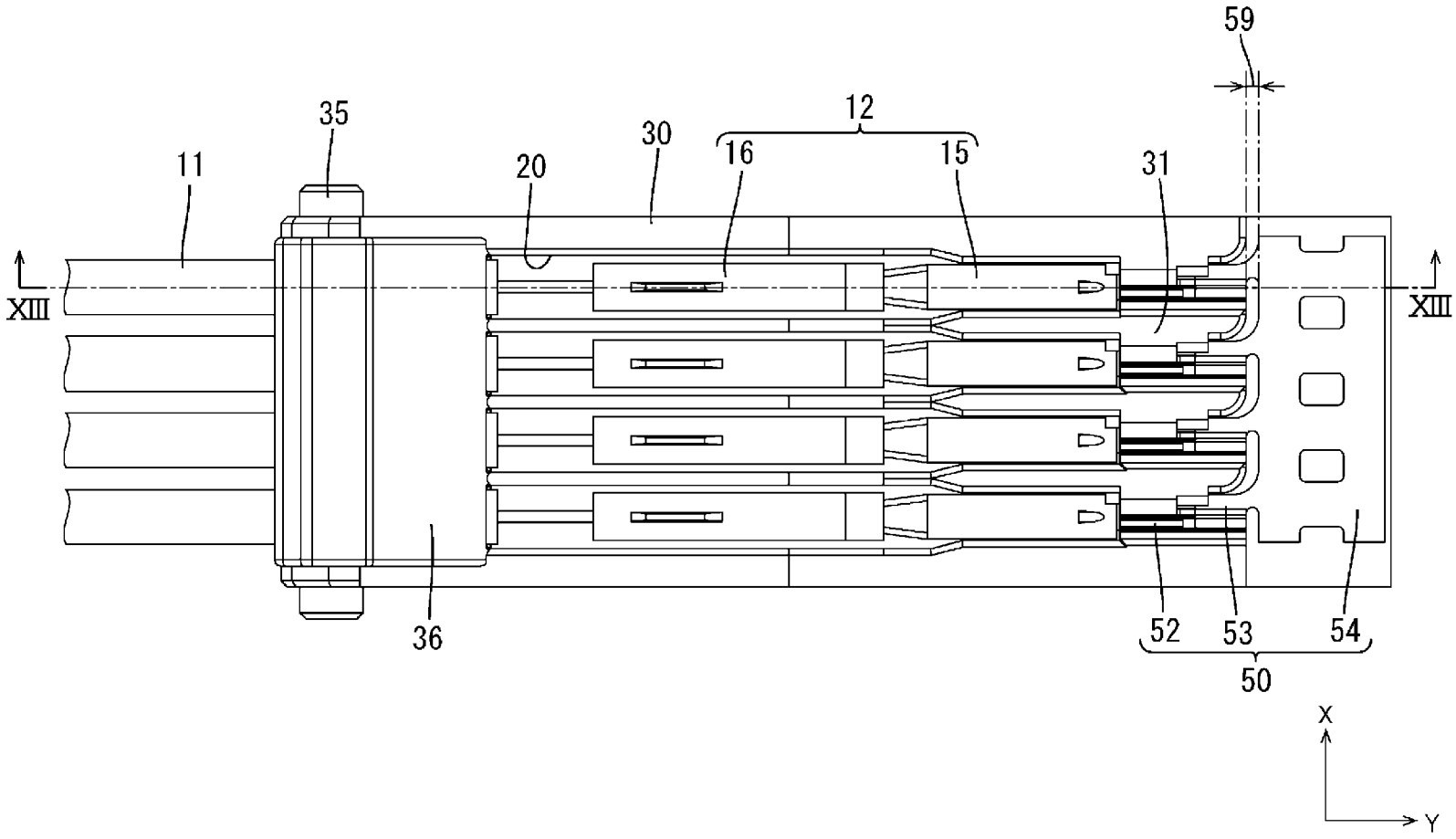
FIG. 12 is a plan view showing a state where slide portions are moved to a full locking position.

As shown in FIGS. 11 and 12, with the busbar 50 placed on the busbar placing portion 32, a clearance 59 is provided between a rear end part of the coupling portion 54 and front end parts of the partition walls 31 of the lower housing 30. By the presence of this clearance 59, the busbar 50 is movable in the front-rear direction together with the terminals 12 to be described later.

[Terminals 12]

Figure 9:
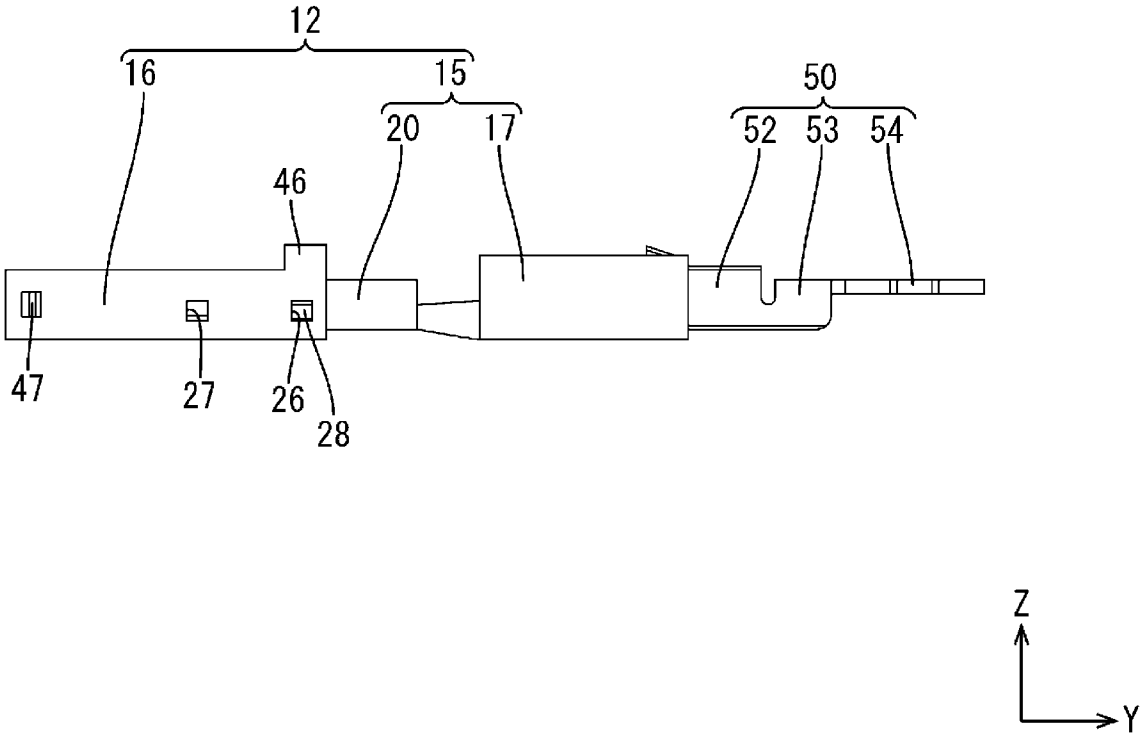
FIG. 9 is a side view showing a state where terminals and the busbar are connected.

As shown in FIG. 9, the terminal 12 includes a terminal body 15 made of metal and a slide portion 16 relatively slidable with respect to the terminal body 15.

[Terminal Bodies 15]

The terminal body 15 is formed into a predetermined shape by a known method such as press-working, cutting or casting. An arbitrary metal such as copper, copper alloy, aluminum, aluminum alloy or stainless steel can be appropriately selected as a metal constituting the terminal body 15 if necessary. The terminal body 15 according to this embodiment is made of copper or copper alloy. A plating layer may be formed on the surface of the terminal body 15. An arbitrary metal such as tin, nickel or silver can be appropriately selected as a metal constituting the plating layer if necessary. Tin plating is applied to the terminal body 15 according to this embodiment.

Figure 10:
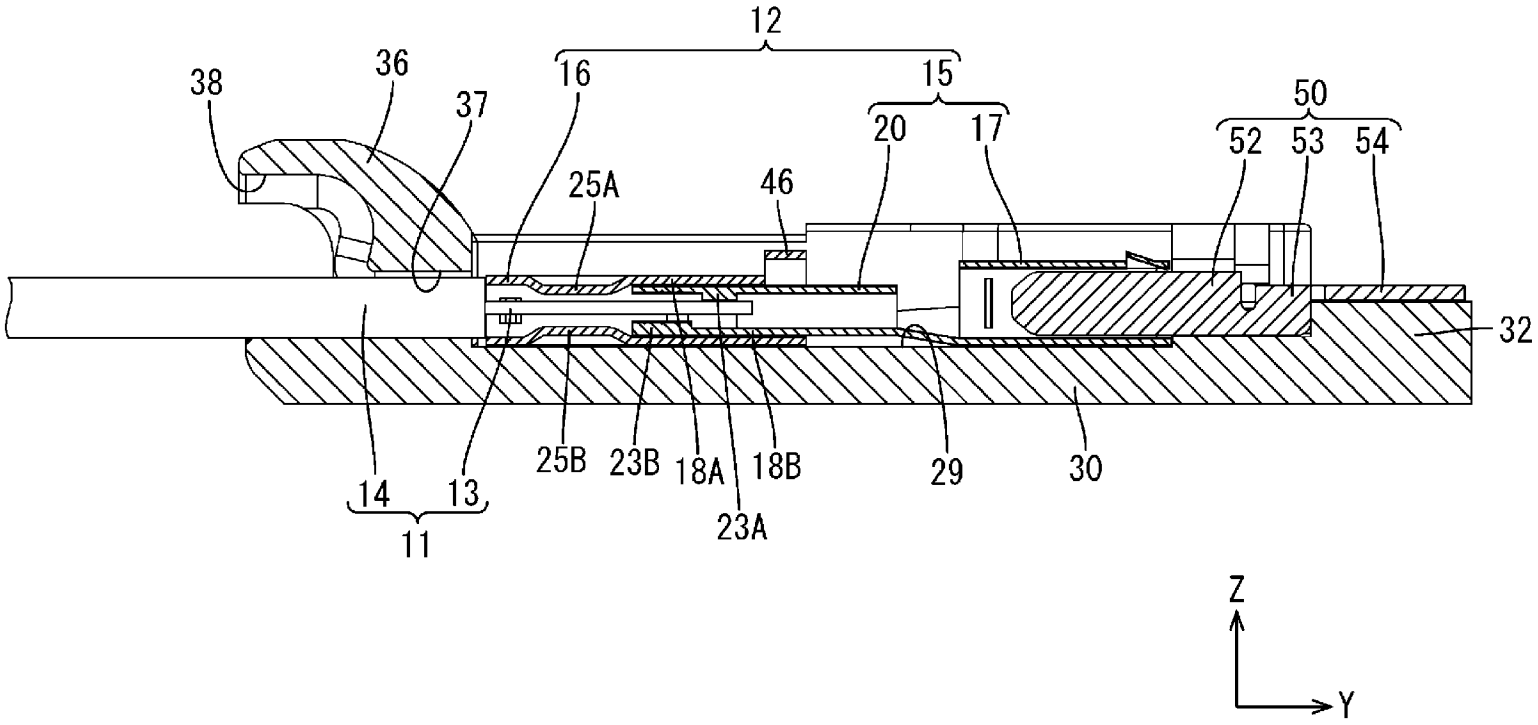
FIG. 10 is a section along X-X in FIG. 11.

As shown in FIG. 10, the terminal body 15 includes a tube portion 17 (an example of a busbar connecting portion) into which the tab 52 is insertable, and a wire connecting portion 20 located behind the tube portion 17 and to be connected to the wire 11. The wire connecting portion 20 includes an upper sandwiching portion 18A and a lower sandwiching portion 18B extending rearward.

As shown in FIG. 10, the tube portion 17 is in the form of a rectangular tube extending in the front-rear direction. The front end of the tube portion 17 is open, so that tab 52 is insertable.

Although not shown in detail, a resiliently deformable resilient contact piece is disposed inside the tube portion 17. The resilient contact piece extends inward from the inner wall of the tube portion 17. The tab 52 inserted into the tube portion 17 presses and resiliently deforms the resilient contact piece. By a resilient force of the resiliently deformed resilient contact piece, the tab 52 is sandwiched between the inner wall of the tube portion 17 and the resilient contact piece. In this way, the tab 52 and the terminal 12 are electrically connected.

As shown in FIG. 10, the wire connecting portion 20 in the form of a rectangular tube is provided behind the tube portion 17. The upper sandwiching portion 18A (an example of a sandwiching portion) is provided to extend rearward in a rear end part of the upper wall of the wire connecting portion 20, and the lower sandwiching portion 18B (an example of the sandwiching portion) is provided to extend rearward in a rear end part of the lower wall of the wire connecting portion 20. The upper and lower sandwiching portions 18A, 18B have a shape elongated in the front-rear direction. Lengths in the front-rear direction of the upper and lower sandwiching portions 18A, 18B are substantially equal.

An upper holding protrusion 23A projecting downward is provided at a position in front of a rear end part on the lower surface of the upper sandwiching portion 18A. A lower holding protrusion 23B projecting upward is provided on a rear end part on the upper surface of the lower sandwiching portion 18B. The lower and upper holding protrusions 23B, 23A are provided at positions shifted in the front-rear direction.

The lower surface of the upper sandwiching portion 18A and the upper surface of the lower sandwiching portion 18B bite into an oxide film formed on the surface of the core 13 to peel off the oxide film, whereby a metal surface of the core 13 is exposed. By the contact of this metal surface and the upper and lower sandwiching portions 18A, 18B, the core 13 and the terminal body 15 are electrically connected.

[Slide Portion 16]

As shown in FIG. 9, the slide portion 16 is in the form of a rectangular tube extending in the front-rear direction. The slide portion 16 is formed by a known method such as cutting, casting or press-working if necessary. An arbitrary metal such as copper, copper alloy, aluminum, aluminum alloy or stainless steel can be appropriately selected as a metal constituting the slide portion 16 if necessary. The slide portion 16 according to this embodiment is made of stainless steel. A plating layer may be formed on the surface of the slide portion 16. An arbitrary metal such as tin, nickel or silver can be appropriately selected as a metal constituting the plating layer if necessary.

As shown in FIG. 10, a cross-section of the inner surface shape of the slide portion 16 is the same as or somewhat larger than that of the outer shape of a region of the terminal body 15 where the upper and lower sandwiching portions 18A, 18B are provided. In this way, the slide portion 16 is disposed outside the region of the terminal body 15 where the upper and lower sandwiching portions 18A, 18B are provided.

As shown in FIG. 10, an upper pressurizing portion 25A (an example of a pressurizing portion) projecting downward is provided on the lower surface of the upper wall of the slide portion 16. A lower pressurizing portion 25B (an example of the pressurizing portion) projecting upward is provided on the upper surface of the lower wall of the slide portion 16.

As shown in FIG. 9, a partial lock receiving portion 26 is open at a position near a front end part in a side wall of the slide portion 16. Further, a full lock receiving portion 27 is open at a position behind the partial lock receiving portion 26 in the side wall of the slide portion 16. The partial lock receiving portion 26 and the full lock receiving portion 27 are resiliently lockable to a locking projection 28 provided on a side wall of the terminal body 15.

With the locking projection 28 of the terminal body 15 and the partial lock receiving portion 26 of the slide portion 16 locked, the slide portion 16 is held at a partial locking position with respect to the terminal body 15. In this state, the upper and lower pressurizing portions 25A, 25B of the slide portion 16 are separated rearward from the rear end edges of the upper and lower sandwiching portions 18A, 18B of the terminal body 15. Further, in this state, an interval between the upper and lower sandwiching portions 18A, 18B is set to be larger than a diameter of the core 13.

With the locking projection 28 of the terminal body 15 and the full lock receiving portion 27 of the slide portion 16 locked, the slide portion 16 is held at a full locking position with respect to the terminal body 15. As shown in FIG. 1, in this state, the upper pressurizing portion 25A of the slide portion 16 is in contact with the upper sandwiching portion 18A from above the upper sandwiching portion 18A. Further, the lower pressurizing portion 25B of the slide portion 16 is in contact with the lower sandwiching portion 18B from below the lower sandwiching portion 18B.

As described above, the slide portion 16 is slidable between the partial locking position and the full locking position described above while being externally fit to the region of the terminal body 15 where the upper and lower sandwiching portions 18A, 18B are provided.

Figure 13:
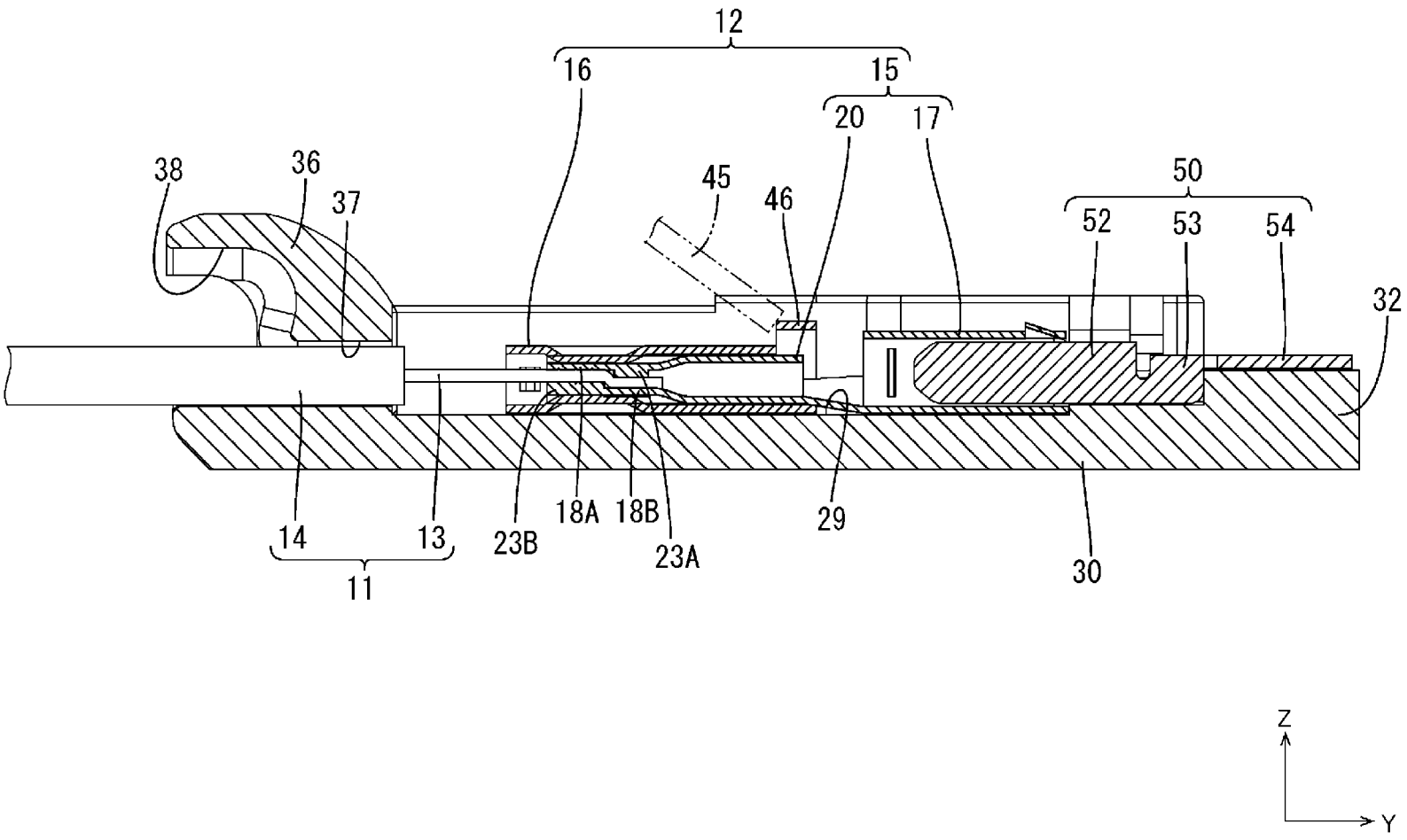
FIG. 13 is a section along XIII-XIII in FIG. 12.

As shown in FIG. 13, with the slide portion 16 held at the full locking position with respect to the terminal body 15, the upper pressurizing portion 25A presses the upper sandwiching portion 18A from above, thereby deforming the upper sandwiching portion 18A downward. Further, the lower pressurizing portion 25B presses the lower sandwiching portion 18B from below, thereby deforming the lower sandwiching portion 18B upward. In this way, with the core 13 extending in the front-rear direction (extending direction) in a space between the upper and lower sandwiching portions 18A, 18B and the slide portion 16 held at the full locking position with respect to the terminal body 15, the core 13 is vertically sandwiched by the resiliently deformed upper and lower sandwiching portions 18A, 18B. That is, the upper sandwiching portion 18A contacts the core 13 from above by being pressed downward by the upper pressurizing portion 25A, and the lower sandwiching portion 18B contacts the core 13 from below by being pressed upward by the lower pressurizing portion 25B.

As shown in FIG. 13, with the slide portion 16 held at the full locking position with respect to the terminal body 15, the upper holding protrusion 23A of the upper sandwiching portion 18A presses the core 13 from above and the lower holding protrusion 23B of the lower sandwiching portion 18B presses the core 13 from below. In this way, the core 13 is pressed from above by the upper holding protrusion 23A and pressed from below by the lower holding protrusion 23B disposed at the position shifted in the front-rear direction from the upper holding protrusion 23A, thereby being held in a state bent in the vertical direction (an example of a direction intersecting the extending direction). The core 13 and the terminal 12 are electrically connected also by the upper and lower holding protrusions 23A, 23B.

As shown in FIG. 13, a jig contact portion 46 projecting upward from the upper wall is provided in a front end part of the slide portion 16. By bringing a jig 45 into contact with the jig contact portion 46 from behind and pushing the slide portion 16 forward by this jig, the slide portion 16 is movable forward.

As shown in FIG. 9, a pair of guiding portions 47 projecting inwardly of the slide portion 16 are provided at positions near a rear end part of the slide portion 16 on both left and right side walls. The guiding portions 47 are formed to become narrower from a rear side toward a front side. The core 13 slides in contact with the inner surfaces of the guiding portions 47, thereby being guided into the slide portion 16.

As shown in FIG. 1, with the upper cover 60 assembled at the closing position with the lower housing 30, the front terminal engaging portion 63F is located above the slide portion 16 to suppress an upward movement of the slide portion 16. The rear terminal engaging portion 63R is located above the wire 11 to suppress an upward movement of the wire 11. A front end part of the front terminal engaging portion 63F contacts the jig contact portion 46 of the slide portion 16 from behind, thereby suppressing rearward movements of the slide portion 16 and the terminal body 15. A front end part of the rear terminal engaging portion 63R contacts the rear end part of the slide portion 16 from behind, thereby suppressing rearward movements of the slide portion 16 and the terminal body 15.

Further, with the upper cover 60 assembled at the closing position with the lower housing 30, the wires 11 are sandwiched between the upper surface of the upper guide portion 69 of the upper cover 60 and the lower surface of the lower guide portion 36 of the lower housing 30, thereby being held in a cranked state in a side view.

[Assembling Process of Joint Connector 10]

Next, an example of an assembling process of the joint connector 10 according to this embodiment is described. The assembling process of the joint connector 10 is not limited to the one described below.

The terminal body 15 and the slide portion 16 are formed by a known method. The slide portion 16 is assembled with the terminal body 15 from behind. The front end edge of the slide portion 16 comes into contact with the locking projection 28 of the terminal body 15 from behind, and the side wall of the slide portion 16 is expanded and deformed. If the slide portion 16 is further pushed forward, the side wall of the slide portion 16 is restored and the partial lock receiving portion 26 of the slide portion 16 is locked to the locking projection 28 of the terminal body 15. In this way, the slide portion 16 is held at the partial locking position with respect to the terminal body 15. In this way, the terminal 12 is obtained.

The lower housing 30 and the upper cover 60 are respectively formed by injection-molding the synthetic resin.

The tabs 52 of the busbar 50 are inserted into the tube portions 17 from front. By the contact of the tabs 52 and the resilient contact pieces, the tabs 52 and the terminals 12 are electrically connected. In this way, the plurality of terminals 12 are electrically connected via the busbar 50 (see FIG. 9).

As shown in FIGS. 10 and 11, the terminals 12 connected to the busbar 50 are inserted into the cavities 29 of the lower housing 30 from above.

The core 13 of the wire 11 is exposed by stripping the insulation coating 14 by a known method. As shown in FIG. 10, the wires 11 are inserted into the wire insertion holes 37 of the lower housing 30 from behind with the cores 13 located on a front side. Since the cavities 29 are located in front of the respective wire insertion holes 37, the wires 11 inserted into the wire insertion holes 37 enter the respective cavities 29.

If the wires 11 are further pushed forward as shown in FIG. 10, front end parts of the cores 13 are introduced into the slide portions 16 through the rear end parts of the slide portions 16. The cores 13 are guided into the slide portions 16 by coming into contact with the guiding portions 47 of the slide portions 16. If the wires 11 are further pushed forward, the front end parts of the cores 13 enter the terminal bodies 15 and reach the spaces between the upper and lower sandwiching portions 18A, 18B.

Subsequently, as shown in FIG. 13, the jig 45 is brought into contact with the jig contact portion 46 to slide the slide portion 16 forward. The slide portion 16 is moved relatively forward with respect to the terminal body 15. At this time, locking between the locking projection 28 of the terminal body 15 and the partial lock receiving portion 26 of the slide portion 16 is released and the side wall of the slide portion 16 rides on the locking projection 28 to be expanded and deformed.

When the slide portion 16 is moved forward, the side wall of the slide portion 16 is restored and the locking projection 28 of the terminal body 15 and the full lock receiving portion 27 of the slide portion 16 are resiliently locked. In this way, the slide portion 16 is held at the full locking position with respect to the terminal body 15.

With the slide portion 16 held at the full locking position with respect to the terminal body 15, the upper pressurizing portion 25A of the slide portion 16 comes into contact with the upper sandwiching portion 18A of the terminal body 15 from above to press the upper sandwiching portion 18A downward. Further, the lower pressurizing portion 25B of the slide portion 16 comes into contact with the lower sandwiching portion 18B of the terminal body 15 from below to press the lower sandwiching portion 18B upward. In this way, the core 13 is sandwiched from upper and lower sides by the upper and lower sandwiching portions 18A, 18B (see FIG. 13).

As shown in FIG. 13, the core 13 is sandwiched by the lower surface of the upper sandwiching portion 18A and the upper surface of the lower sandwiching portion 18B, whereby the oxide film formed on the surface of the core 13 is peeled off to expose the metal surface constituting the core 13. By the contact of this metal surface with the upper and lower sandwiching portions 18A, 18B, the wire 11 and the terminal 12 are electrically connected. In this way, the plurality of wires 11 are electrically connected via the terminals 12 and the busbar 50.

With the core 13 sandwiched from upper and lower sides by the upper and lower sandwiching portions 18A, 18B, the core 13 is sandwiched by the upper holding protrusion 23A of the upper sandwiching portion 18A and the lower holding protrusion 23B of the lower sandwiching portion 18B, thereby being held in the state extending in the front-rear direction and bent in the vertical direction. Since the core 13 can be firmly held in this way, a holding force of the wire 11 and the terminal 12 can be enhanced when a pulling force is applied to the wire 11.

As shown in FIG. 14, the upper cover 60 is assembled with the lower housing 30. At this time, the upper cover 60 is so assembled with the lower housing 30 from behind that the wires 11 are inserted into the opening 68 of the upper cover 60 with the upper cover 60 set in a posture intersecting the lower housing 30. The shaft portions 35 of the lower housing 30 are fit into the shaft holes 67 of the upper cover 60. In this way, the upper cover 60 is assembled at the opening position with the lower housing 30.

As shown in FIG. 14, with the upper cover 60 assembled at the opening position with the lower housing 30, the opening 68 of the upper cover 60 and the wire insertion holes 37 of the lower housing 30 communicate straight with each other. In this way, the wires 11 can be smoothly inserted into the lower housing 30.

Figure 15:
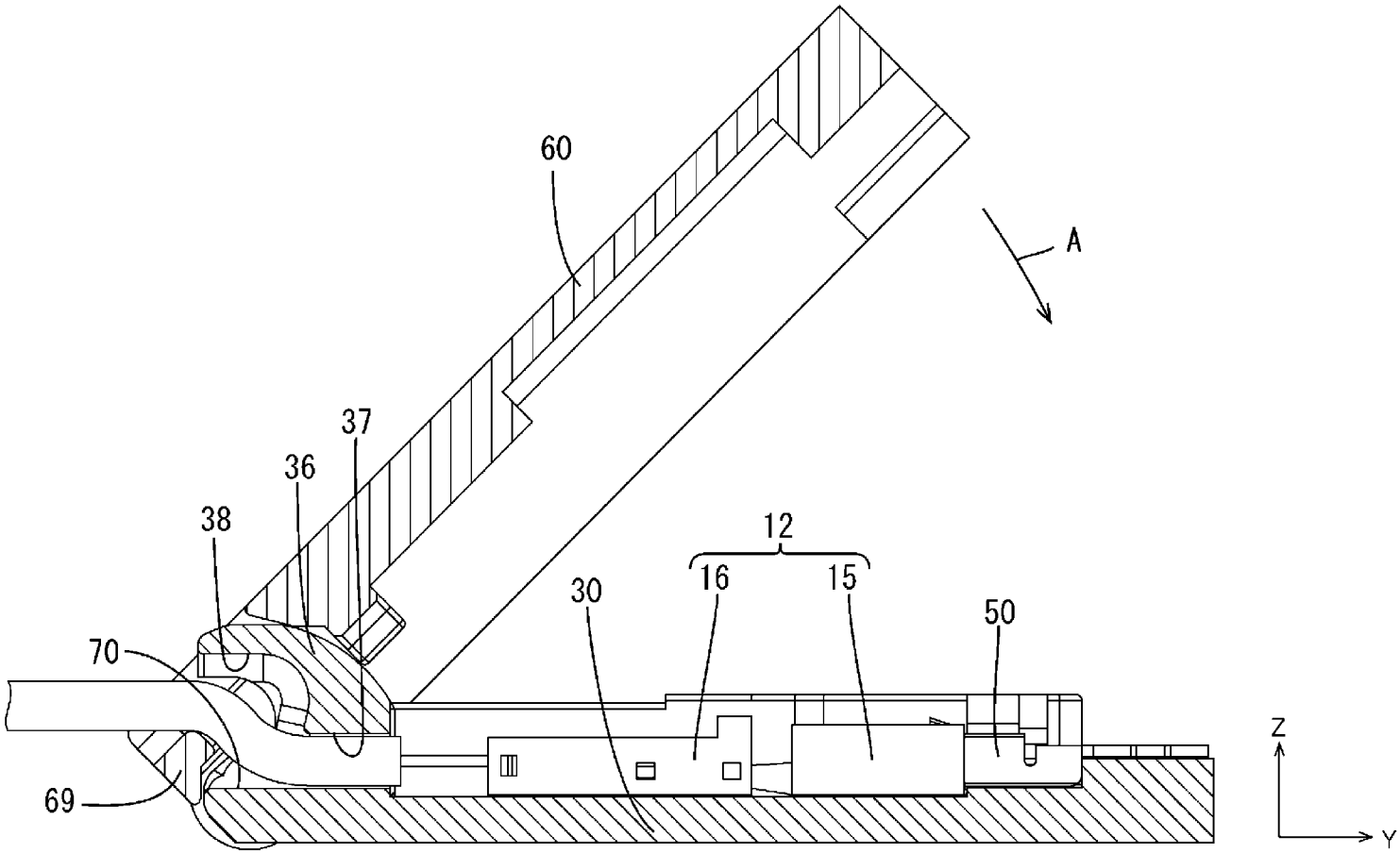
FIG. 15 is a section showing a state where the upper cover is being rotated.

As shown in FIG. 15, the upper cover 60 is rotated clockwise (direction indicated by an arrow A) in FIG. 15 with the shaft portions 35 as an axis of rotation. Then, the upper contact portion 70 of the upper guide portion 69 of the upper cover 60 contacts the wires 11, whereby the wires 11 are bent.

If the upper cover 60 is further rotated and reaches the closing position as shown in FIG. 1, the lock claws 66 of the upper cover 60 are resiliently engaged with the lock receiving portions 33 provided on the side walls of the lower housing 30, whereby the lower housing 30 and the upper cover 60 are integrally assembled.

The wires 11 are held in the cranked state by being sandwiched between the lower guide portion 36 of the lower housing 30 and the upper guide portion 69 of the upper cover 60. In this way, the joint connector 10 is completed. Even if the wires 11 move in the front-rear direction by being sandwiched between the lower guide portion 36 and the upper guide portion 69, the wires 11 and the busbar 50 move in the front-rear direction together with the terminals 12 since the clearance 59 is provided. In this way, the application of a force to the busbar 50 and the terminals 12 is suppressed.

[Functions and Effects of Embodiment]

Next, functions and effects of this embodiment are described. The joint connector 10 of this embodiment is for connecting the plurality of wires 11 and includes the lower housing 30 and the upper cover 60, the lower housing 30 accommodates the plurality of terminals 12 to be respectively connected to the front end parts in the extending direction of the plurality of wires 11, the upper cover 60 is assembled to close the upper surface of the lower housing 30, and the lower housing 30 and the upper cover 60 respectively include the lower guide portion 36 and the upper guide portion 69 for bending the plurality of wires 11 by contacting the plurality of wires 11 with the lower housing 30 and the upper cover 60 assembled.

If an external force is applied to the plurality of wires 11, this external force is transmitted to the joint connector 10 along the respective wires 11. Since the force transmitted to each wire 11 is absorbed by a bent part of the wire 11, the transmission of the force applied to the wire 11 to the terminal 12 is suppressed.

Further, since the wire 11 is sandwiched by the lower guide portion 36 and the upper guide portion 69, the transmission of the force transmitted to the wire 11 to the terminal 12 beyond a part of the wire 11 sandwiched by the lower guide portion 36 and the upper guide portion 69 is suppressed. In this way, the transmission of the force applied to the wire 11 to the terminal 12 is suppressed.

According to this embodiment, the upper cover 60 is assembled with the lower housing 30 rotatably between the opening position for opening the upper surface of the lower housing 30 and the closing position for closing the upper surface of the lower housing 30, and the lower guide portion 36 and the upper guide portion 69 bend the plurality of wires 11 by contacting the plurality of wires 11 at the closing position.

Since a step of rotating the upper cover 60 from the opening position to the closing position and a step of bending the wires 11 can be performed in one step, a manufacturing process of the joint connector 10 can be made efficient.

According to this embodiment, the lock claws 66 provided on the upper cover 60 are locked to the lock receiving portions 33 provided on the lower housing 30, whereby the upper cover 60 is assembled at the closing position with the lower housing 30, the lower guide portion 36 and the upper guide portion 69 are provided near the axis of rotation, about which the upper cover 60 rotates with respect to the lower housing 30, and the lock claws 66 are provided at positions distant from the axis of rotation.

The lower guide portion 36 and the upper guide portion 69 for bending the wires 11 are provided near the axis of rotation, whereas a configuration for locking the upper cover 60 and the lower housing 30 is distant from the axis of rotation. Thus, a load in locking the upper cover 60 and the lower housing 30 can be effectively utilized as a force for bending the wires 11 by the principle of leverage. In this way, the wires 11 can be bent.

According to this embodiment, the upper surface of the lower guide portion 36 has a shape along the trajectory of the upper cover 60 moving between the opening position and the closing position. This can suppress the contact of the upper cover 60 and an upper part of the lower guide portion 36 when the upper cover 60 is rotated with respect to the lower housing 30.

According to this embodiment, the lower guide portion 36 includes the lower contact portion 38 for bending the plurality of wires 11 by contacting the plurality of wires 11, and the upper guide portion 69 includes the upper contact portion 70 for bending the plurality of wires 11 by contacting the plurality of wires 11.

Since the wires 11 are held in contact with both the upper contact portion 70 of the upper cover 60 and the lower contact portion 38 of the lower housing 30, a force applied to the wires 11 can be received by both the upper cover 60 and the lower housing 30. In this way, the transmission of the force applied to the wires 11 to the terminals 12 can be suppressed.

According to this embodiment, the lower guide portion 36 includes the lower contact portion 38 for bending the plurality of wires 11 by contacting the plurality of wires 11, and the upper guide portion 69 includes the upper contact portion 70 for bending the plurality of wires 11 by contacting the plurality of wires 11.

Since the lower guide portion 36 provided on the lower housing 30 contacts the wires 11, if a force is applied to the wires 11, this force can be received by the lower housing 30. Further, since the upper guide portion 69 provided on the upper cover 60 contacts the wires 11, if a force is applied to the wires 11, this force can be received by the upper cover 60. As just described, according to this embodiment, the force applied to the wires 11 can be received by both the lower housing 30 and the upper cover 60. In this way, the transmission of the force applied to the wires 11 to the terminals 12 can be more suppressed.

Since the lower contact portion 38 and the upper contact portion 69 have a curved surface shape, the wires 11 contact curved surface parts of the lower contact portion 38 and the upper contact portion 70. In this way, the wires 11 are gently bent along the curved surface shapes, wherefore a concentration of a stress on the wires 11 can be suppressed.

According to this embodiment, the lower housing 30 includes the wire insertion holes 37 for respectively positioning the plurality of wires 11 by contacting the plurality of wires 11.

The plurality of wires 11 are respectively positioned in the lower housing 30 by the wire insertion holes 37 provided in the lower housing 30. In this way, the bent parts of the plurality of wires 11 can be precisely positioned.

According to this embodiment, the busbar 50 to be connected to the plurality of terminals 12 is provided and includes the plurality of tabs 52 and the coupling portion 54 coupling the plurality of tabs 52, each of the plurality of terminals 12 includes the tube portion 17 to be connected to one of the plurality of tabs 52, the upper and lower sandwiching portions 18A, 18B extending along the front-rear direction and configured to sandwich the wire 11 and the slide portion 16 disposed outside the upper and lower sandwiching portions 18A, 18B and movable along the front-rear direction, and the slide portion 16 includes the upper and lower pressurizing portions 25A, 25B for pressurizing the upper and lower sandwiching portions 18A, 18B toward the wire 11 with one of the plurality of wires 11 sandwiched by the upper and lower sandwiching portions 18A, 18B.

Since the wire 11 and the terminal 12 are connected by the upper and lower sandwiching portions 18A, 18B being pressed by the upper and lower pressurizing portions 25A, 25B, dies necessary in crimping a barrel to the outer periphery of the wire 11 become unnecessary and the manufacturing cost of the joint connector 10 can be reduced.

According to this embodiment, the upper cover 60 includes the terminal engaging portions 63 to be engaged with the terminals 12 with the upper cover 60 assembled with the lower housing 30.

Even if a force is applied to the terminal 12 due to vibration or the like, this force can be received by the terminal engaging portion 63 engaged with the terminal 12. Thus, the terminal 12 can be held in the lower housing 30.

According to this embodiment, the terminals 12 include a plurality of the wire connecting portions 20 to be connected to the plurality of wires 11 and the slide portions 16, each of the plurality of wire connecting portions 20 includes the upper and lower sandwiching portions 18A, 18B extending along the front-rear direction and configured to sandwich one of the plurality of wires 11, the slide portion 16 is disposed outside the upper and lower sandwiching portions 18A, 18B and movable along the front-rear direction between the full locking position and the partial locking position different from the full locking position, the slide portion 16 includes the upper and lower pressurizing portions 25A, 25B for pressurizing the upper and lower sandwiching portions 18A, 18B toward the wire 11 with one of the plurality of wires 11 sandwiched by the upper and lower sandwiching portions 18A, 18B when the slide portion 16 moves to the full locking position, and the upper cover 60 includes the front and rear terminal engaging portions 63F, 63R to be engaged with the terminals 12 having the slide portions 16 disposed at the full locking position.

By assembling the upper cover 60 with the lower housing 30, the front terminal engaging portions 63F of the upper cover 60 engage the jig contact portions 46 of the slide portions 16 moved to the full locking position from behind. Further, the rear terminal engaging portions 63R engage the rear end parts of the slide portions moved to the full locking position from behind. In this way, whether or not the slide portions 16 have moved to the full locking position in the terminals 12 can be detected.

Second Embodiment

Figure 16:
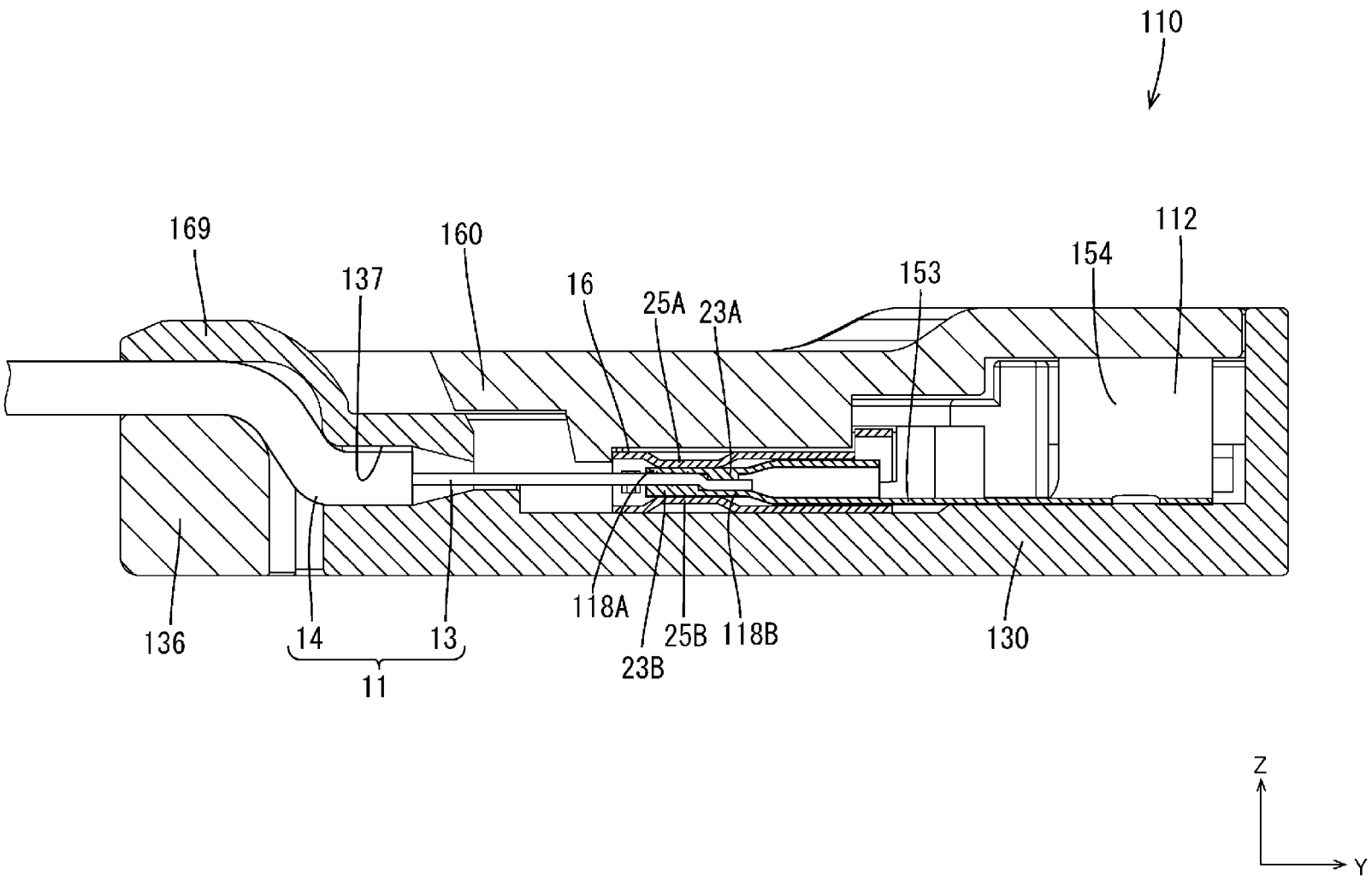
FIG. 16 is a section showing a joint connector according to a second embodiment.

Next, a joint connector 110 according to a second embodiment of the present disclosure is described with reference to FIGS. 16 and 25. As shown in FIG. 16, the joint connector 110 includes a lower housing 130 and an upper cover 160 to be assembled with the lower housing 130.

[Lower Housing 130]

Figure 17:
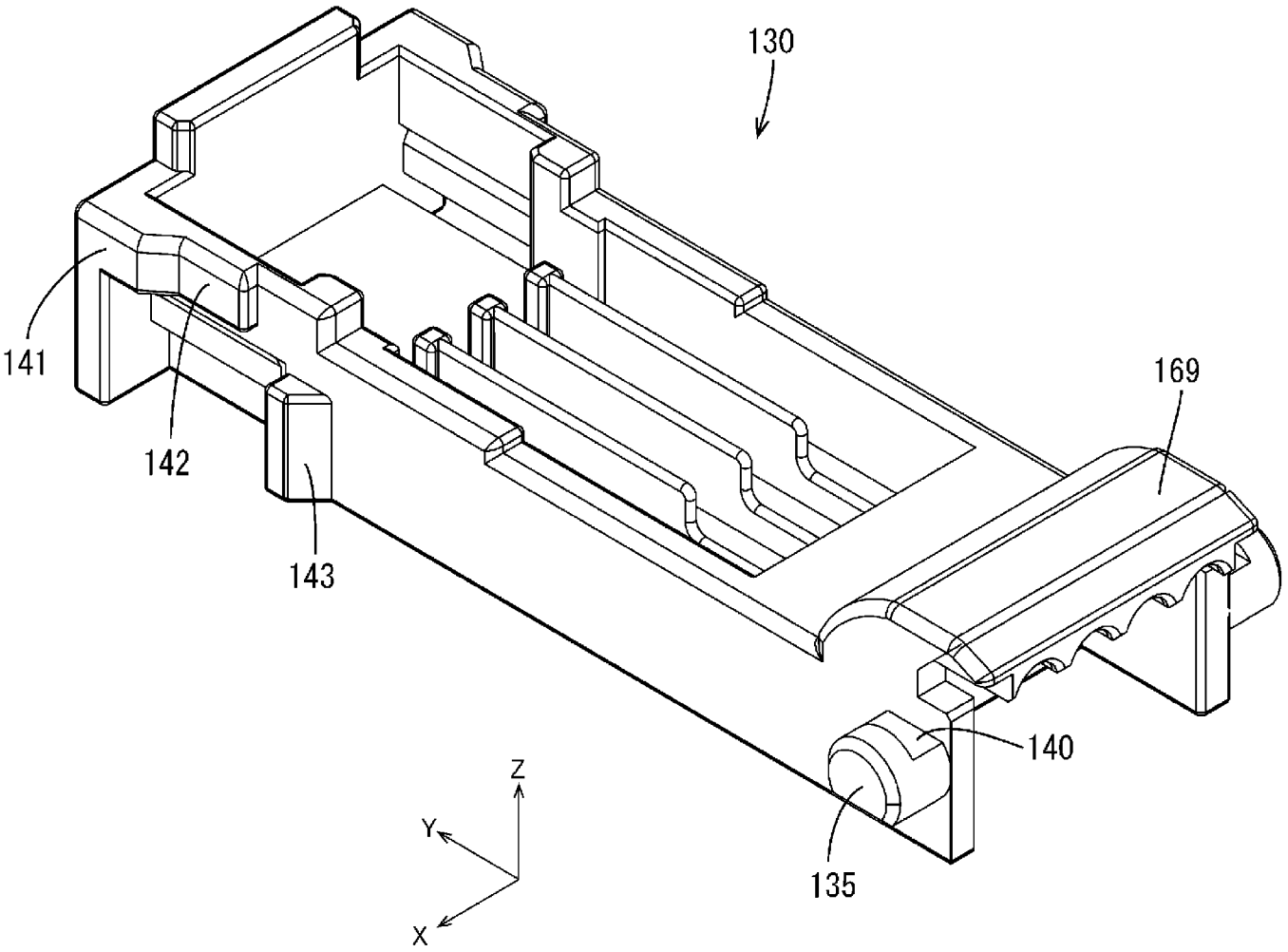
FIG. 17 is a perspective view showing a lower housing.

As shown in FIG. 17, a shaft portion 135 projecting on a side wall of the lower housing 130 has a substantially cylindrical shape. The upper and lower surfaces of the shaft portion 135 are cut to form flat surfaces 140 extending in a front-rear direction.

A slide guide portion 141 extending rearward from a front end part is formed on the upper end edge of the side wall of the lower housing 130. A rear end part of the slide guide portion 141 serves as a narrow portion 142 formed to be narrower than a front end part.

A slide lock portion 143 projecting outward is provided at a position behind and below the slide guide portion 141 on the side wall of the lower housing 130.

As shown in FIG. 16, wire insertion holes 137 formed in a lower guide portion 136 of the lower housing 130 are formed into a shape tapered toward a front side. An inner diameter of the tapered part of the wire insertion hole 137 is set to be smaller than a diameter of an insulation coating 14 of a wire 11 and larger than a diameter of a core 13.

[Upper Cover 160]

Figure 18:
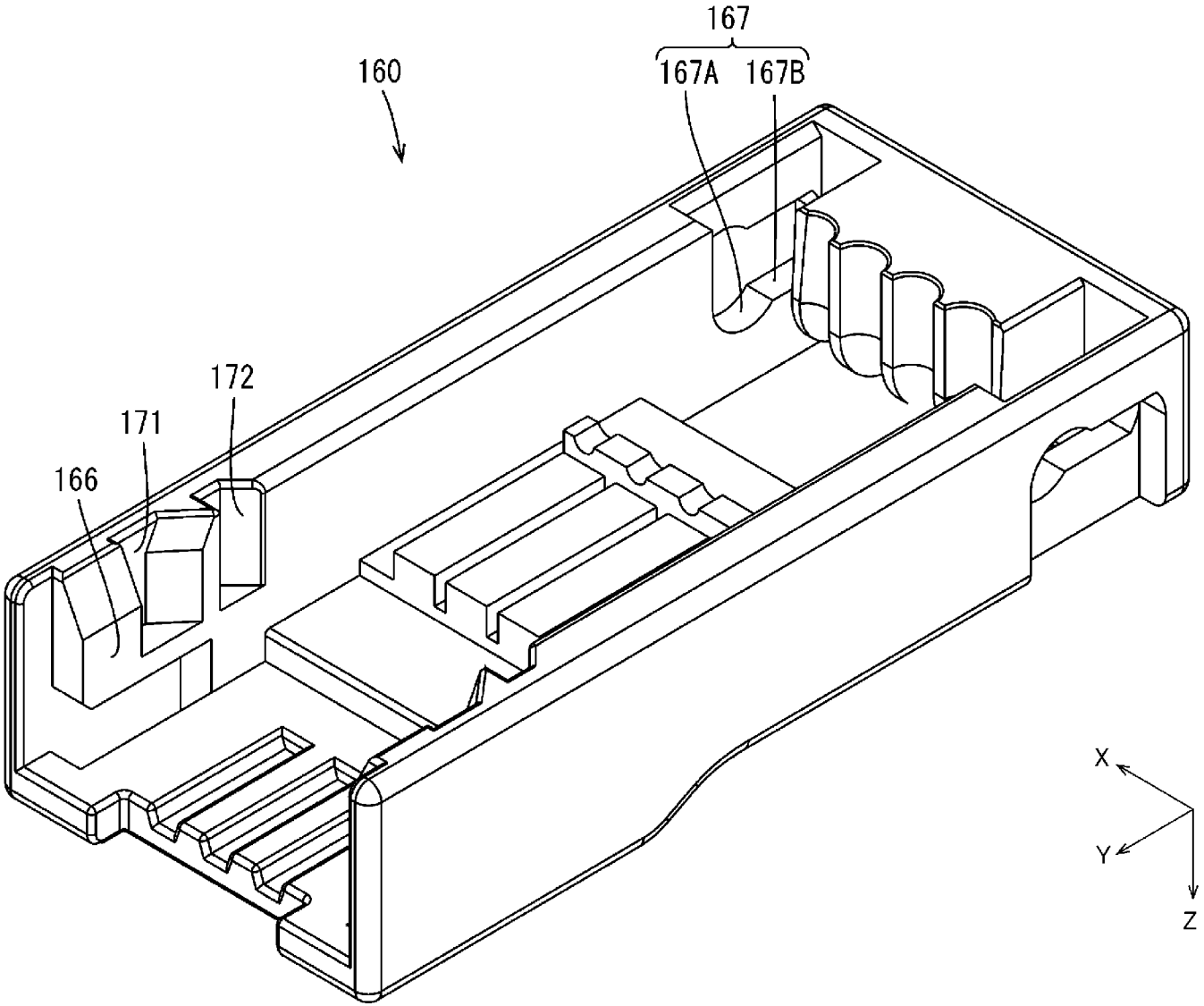
FIG. 18 is a perspective view showing an upper cover.

As shown in FIG. 18, a lock claw 166 is formed on a front end part of a side wall of the upper cover 160. The lock claw 166 is provided with a cut portion 171 cut upward from a lower end part of the lock claw 166.

A slide lock receiving portion 172 is formed on the side wall of the upper cover 160 by recessing the side wall of the upper cover 160 behind the lock claw 166. The slide lock portions 143 of the lower housing 130 are fit into these slide lock receiving portions 172, whereby the upper cover 160 and the lower housing 130 are assembled with movements in the front-rear direction restricted.

A shaft hole 167 provided in the upper cover 160 includes a rotating portion 167A having a circular inner shape and an extending portion 167B extending rearward from the rotating portion.

The shaft portion 135 is fit into the rotating portion 167A. The shaft portion 135 is rotatable between an opening position and a temporary closing position as described later while being fit in the rotating portion 167A.

The extending portion 167B has a rectangular inner shape extending in the front-rear direction. A height in a vertical direction of this extending portion 167B is set to be equal to or somewhat larger than a vertical interval between the flat surfaces 140 provided on upper and lower parts of the shaft portion 135 of the lower housing 130. This makes the upper cover 160 movable in the front-rear direction with the extending portions 167B of the shaft holes 167 and the flat surfaces 140 of the shaft portions 135 fit to each other.

[Terminals 12]

As shown in FIG. 16, a terminal 112 includes an upper sandwiching portion 118A and a lower sandwiching portion 118B for vertically sandwiching the wire 11. An extending portion 153 extends in front of the upper and lower sandwiching portions 118A, 118B. A plurality of (four in this embodiment) the extending portions 153 are connected by a coupling portion 154 extending in a lateral direction.

Figure 19:
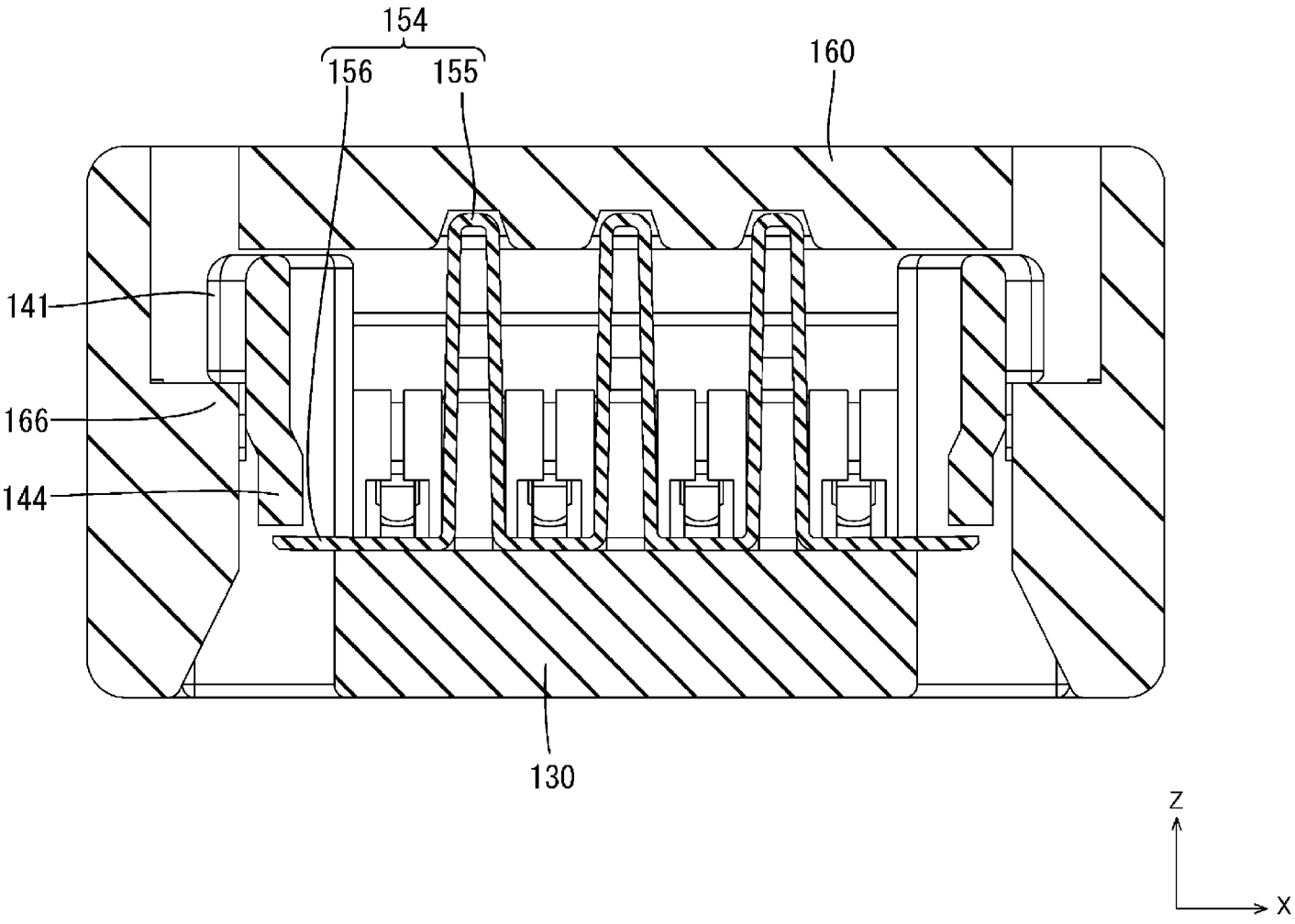
FIG. 19 is a section along XXIV-XXIV in FIG. 20.

As shown in FIG. 19, the coupling portion 154 is formed with a plurality of (three in this embodiment) bent portions 155 bent into a chevron shape projecting upward (an example of a direction intersecting plate surfaces of the coupling portion 154). The bent portions 155 are formed by bending a part, which is a so-called carrier having the tabs 52 coupled thereto.

Figure 20:
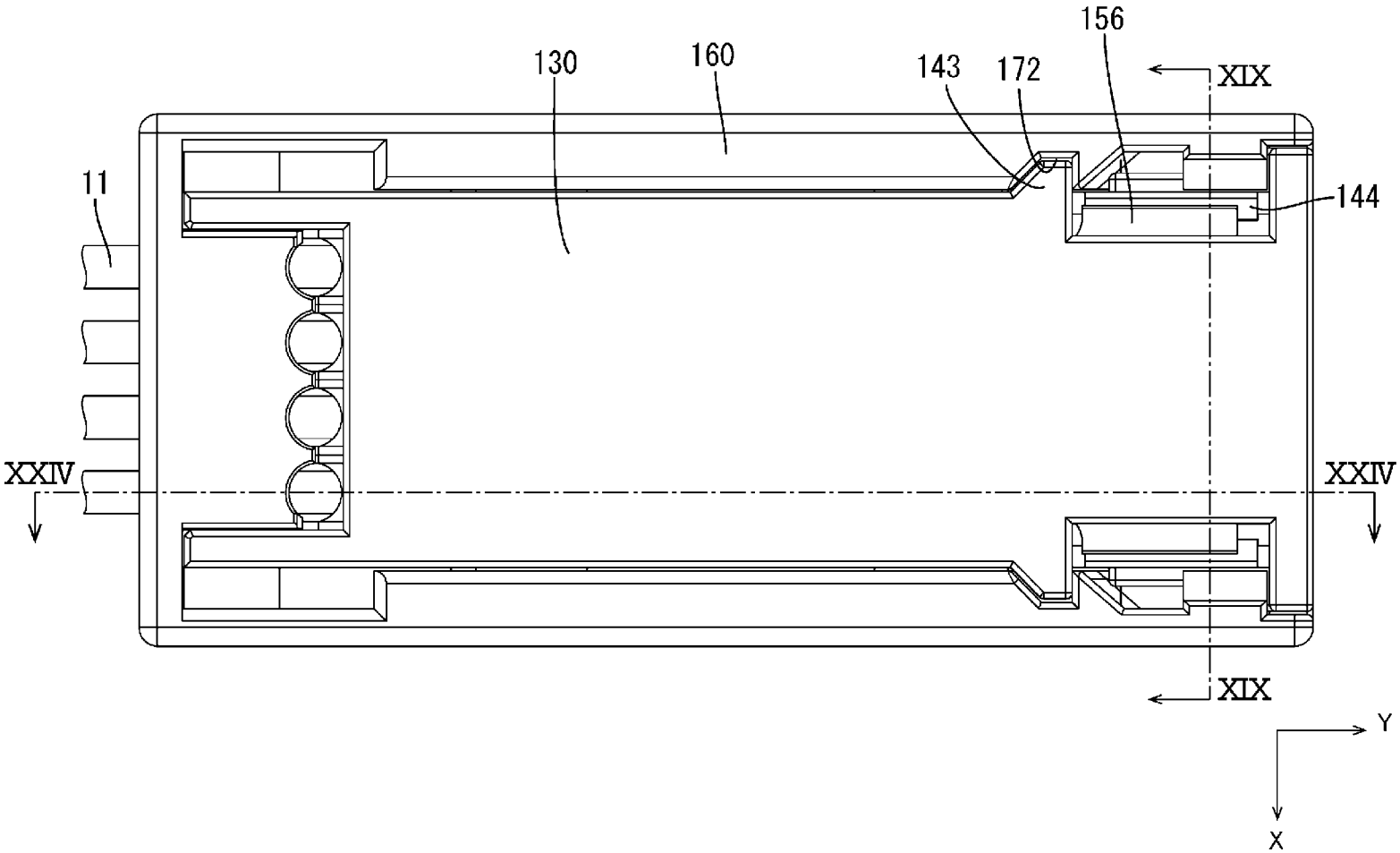
FIG. 20 is a bottom view showing the joint connector.

Left and right end parts 156 of the coupling portion 154 respectively project outward from both left and right end parts of a busbar placing portion 32 (see FIG. 20). Terminal locking portions 144 provided in the lower housing 130 contact the end parts 156 of the coupling portion 154 from above, whereby the end parts 156 are held not to come out upward.

Since the other configuration is substantially the same as in the first embodiment, the same members are denoted by the same reference signs and repeated description is omitted.

[Assembling Process of Joint Connector 110]

Next, an example of an assembling process of the joint connector 110 according to this embodiment is described. The assembling process of the joint connector 110 is not limited to the one described below.

Figure 21:
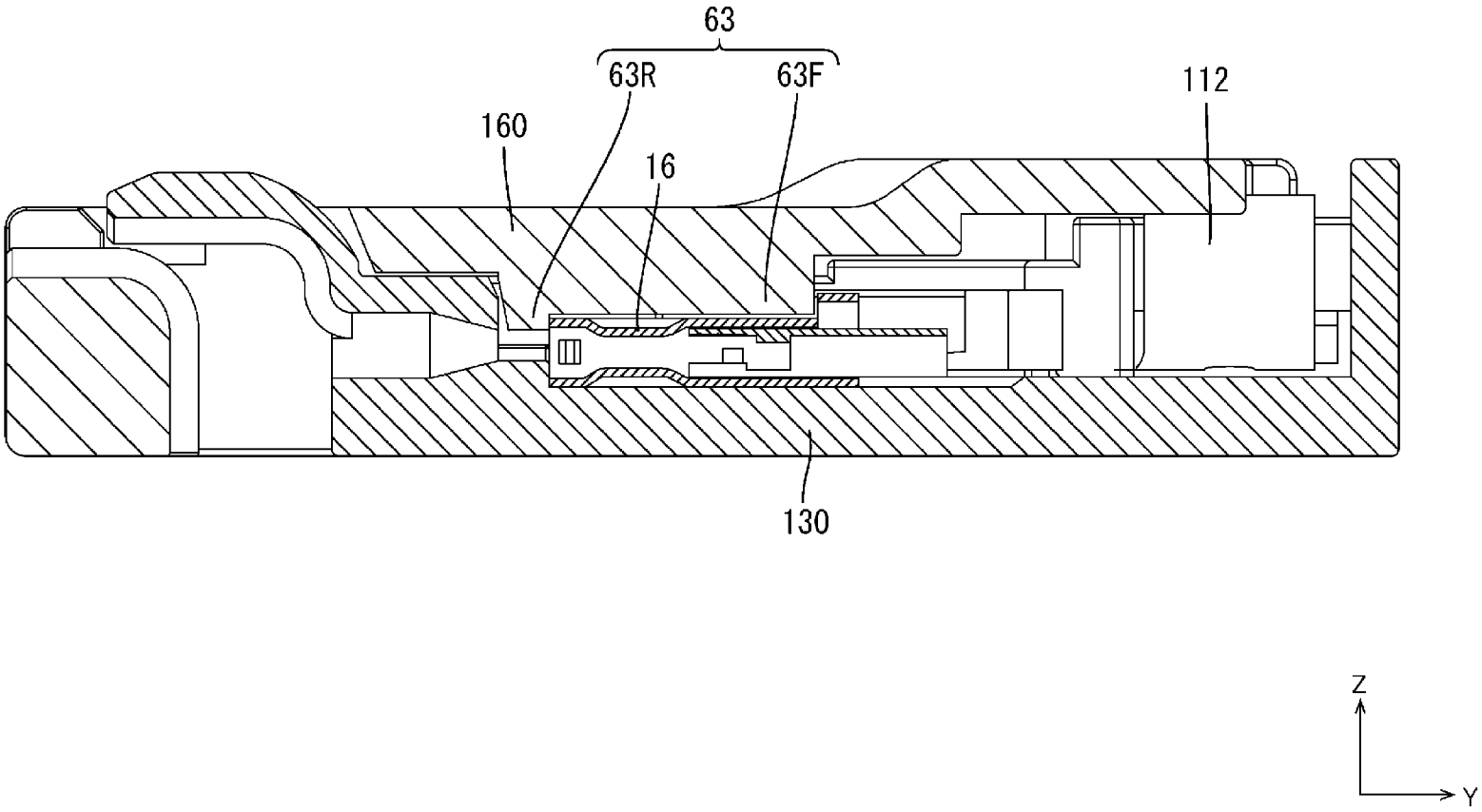
FIG. 21 is a section showing a state where the upper cover is assembled at a partial locking position with the lower housing and terminals having slide portions partially locked are accommodated.

As shown in FIG. 21, the terminals 112 having slide portions 16 partially locked in the terminals 112 are accommodated in the lower housing 130. The upper cover 160 is mounted at the temporary closing position for closing a part of the upper surface of the lower housing 130 with respect to the lower housing. In this state, out of terminal engaging portions 63 of the upper cover 160, front end parts of front terminal engaging portions 63F are in contact with jig contact portions 46 from behind and front end parts of rear terminal engaging portions 63R are in contact with the slide portions 16 from behind, whereby rearward movements of the terminals 112 are suppressed.

The coupling portion 154 of the terminals 112 is locked by the terminal locking portions 144 of the lower housing 130, whereby forward movements of the terminals 112 are suppressed.

Figure 22:
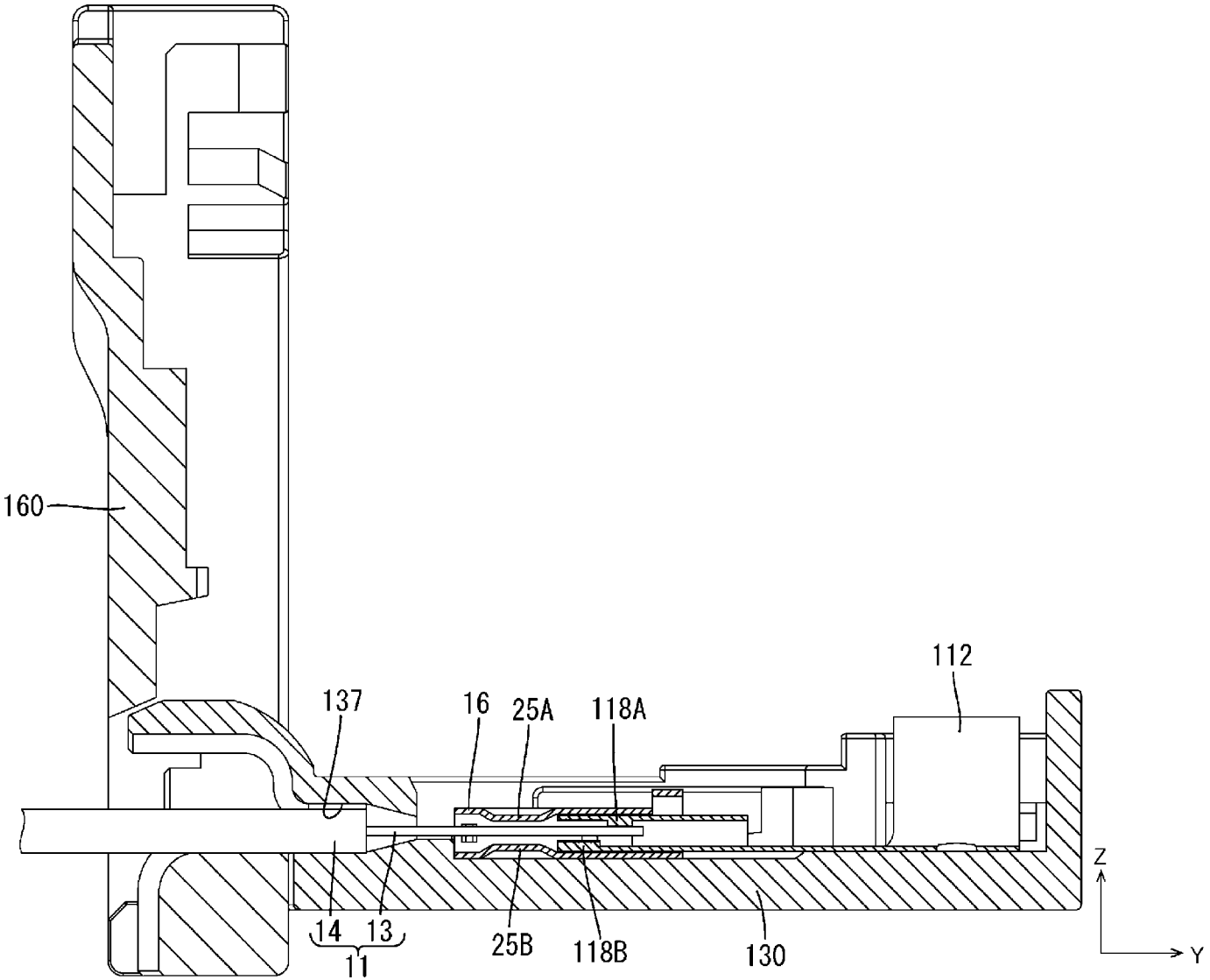
FIG. 22 is a section showing a state where the upper cover is assembled at an opening position.

As shown in FIG. 22, the upper cover 160 is rotated to an opening position. The stripped wires 11 are inserted into the wire insertion holes 137 from behind. The cores 13 are inserted into the slide portions 16 and further inserted between the upper and lower sandwiching portions 118A, 118B.

Figure 23:
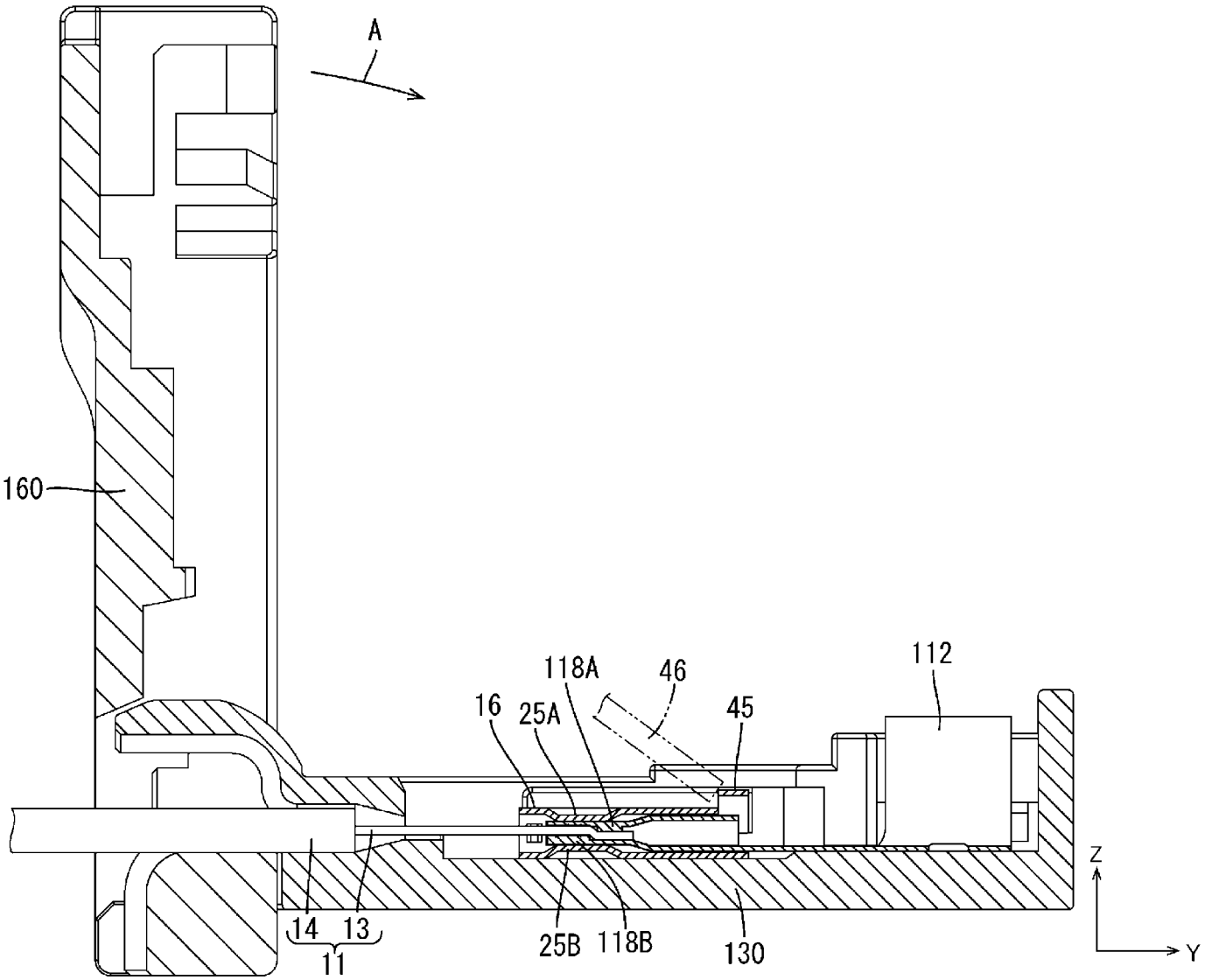
FIG. 23 is a section showing a state where the slide portions are moved to a full locking position.

As shown in FIG. 23, the slide portions 16 are moved forward by bringing the jig 45 into contact with the jig contact portions 46 from behind. In this way, the cores 13 of the wires 11 are sandwiched by the upper and lower sandwiching portions 118A, 118B, whereby the cores 13 and the terminals 112 are electrically connected. The upper cover 160 is rotated in a direction indicated by an arrow A.

Figure 24:
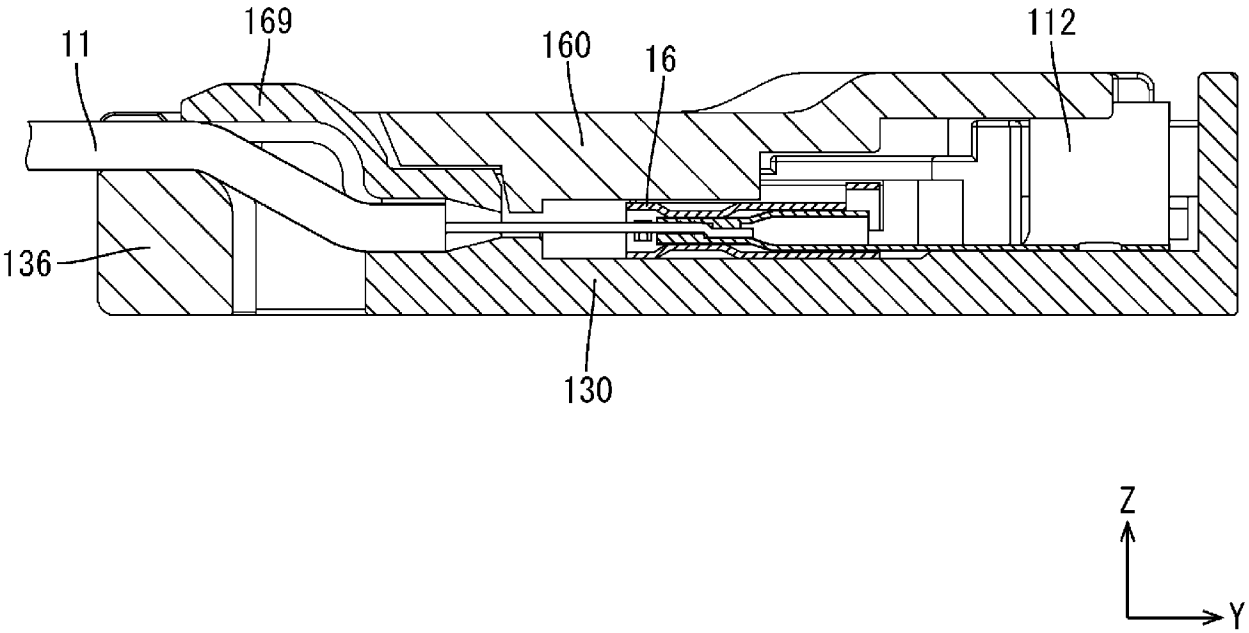
FIG. 24 is a section showing a state where the upper cover is assembled at a temporary closing position.

As shown in FIG. 24, the upper cover 160 is assembled at the temporary closing position by being rotated with respect to the lower housing 130. In this state, the insulation coatings 14 of the wires 11 are relatively gently bent. In this way, a force for rotating the upper cover 160 from the opening position to the temporary closing position can be reduced.

Figure 25:
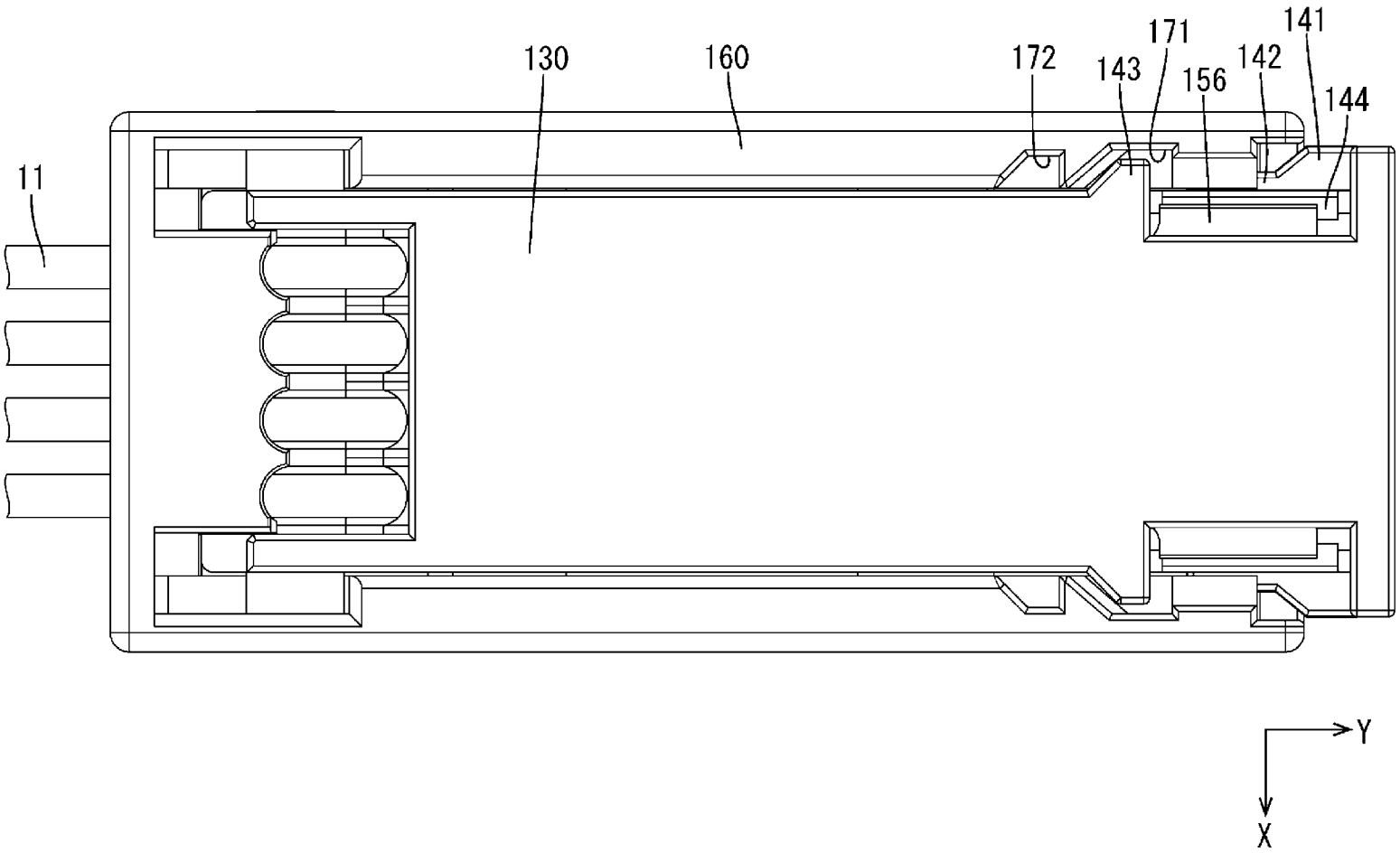
FIG. 25 is a bottom view showing the state where the upper cover is assembled at the temporary closing position.

With the upper cover 160 held at the temporary closing position with respect to the lower housing 130 as shown in FIG. 25, the slide lock portions 143 are fit in the cut portions 171. A front end part of the upper cover 160 is located somewhat behind the slide guide portions 141.

The upper cover 160 is assembled at a closing position with the lower housing 130 by being moved forward. The front end part of the upper cover 160 is guided forward by sliding in contact with the slide guide portions 141. As shown in FIG. 20, the slide lock portions 143 are fit in the slide lock receiving portions 172. In this way, the lower housing 130 and the upper cover 160 are positioned and held in the front-rear direction.

As shown in FIG. 16, the wires 11 are held in a bent state by being sandwiched by the lower guide portion 136 and an upper guide portion 169. In this way, even if an external force is applied to the wires 11, the force is absorbed in the bent parts of the wires 11. Thus, the transmission of the force to the terminals 112 is suppressed. In this way, the joint connector 110 is completed.

[Functions and Effects of Embodiment]

Next, functions and effects of this embodiment are described. In this embodiment, the upper cover 160 is assembled with the lower housing 130 movably along the front-rear direction between the temporary closing position for closing the part of the upper surface of the lower housing 130 and the closing position.

The wires 11 can be held in the bent state by moving the upper cover 160 from the temporary closing position to the closing position. In this way, the transmission of an external force applied to the wires 11 to the inside of the joint connector 110 can be more suppressed.

According to this embodiment, the lower housing 130 includes the shaft portions 135 projecting toward the upper cover 160, the upper cover 160 includes the shaft holes 167 to be engaged with the shaft portions 135, the shaft hole 167 includes the rotating portion 167A to be relatively rotatably engaged with the shaft portion 135 and the extending portion 167B extending from the rotating portion 167A, and the extending portion 167B extends along the front-rear direction with the upper cover 160 disposed at the temporary closing position with respect to the lower housing 130.

By moving the shaft portions 135 in the extending portions 167B along the front-rear direction after rotating the upper cover 160 from the opening position to the temporary closing position with the shaft portions 135 engaged with the rotating portions 167A of the shaft holes 167, the upper cover 160 can be easily moved from the temporary closing position to the closing position.

Third Embodiment

Figure 26:
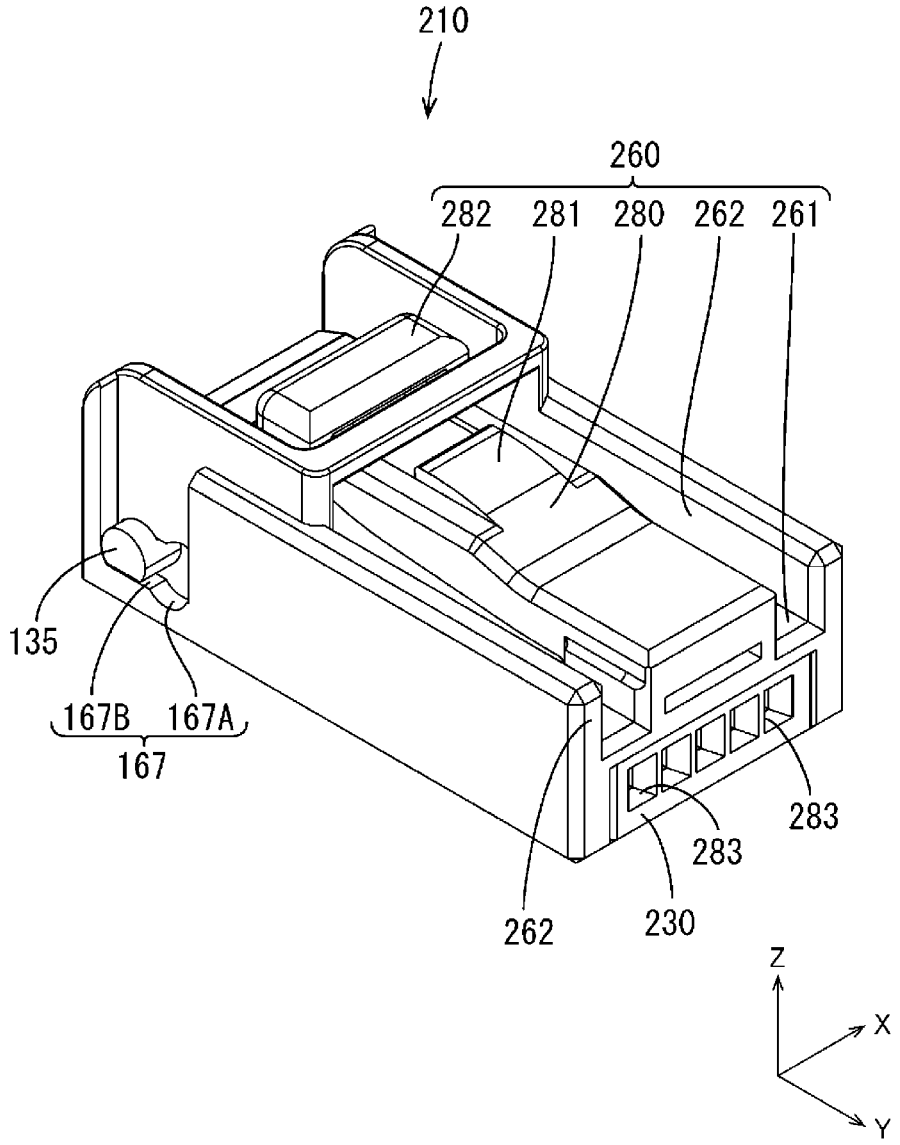
FIG. 26 is a perspective view showing a female connector according to a third embodiment.

Next, a female connector 210 according to a third embodiment of the present disclosure is described with reference to FIGS. 26 and 29. As shown in FIG. 26, the female connector 210 includes a lower housing 230, an upper cover 260 and female terminals 212 (an example of terminals).

[Lower Housing 230]

Figure 27:
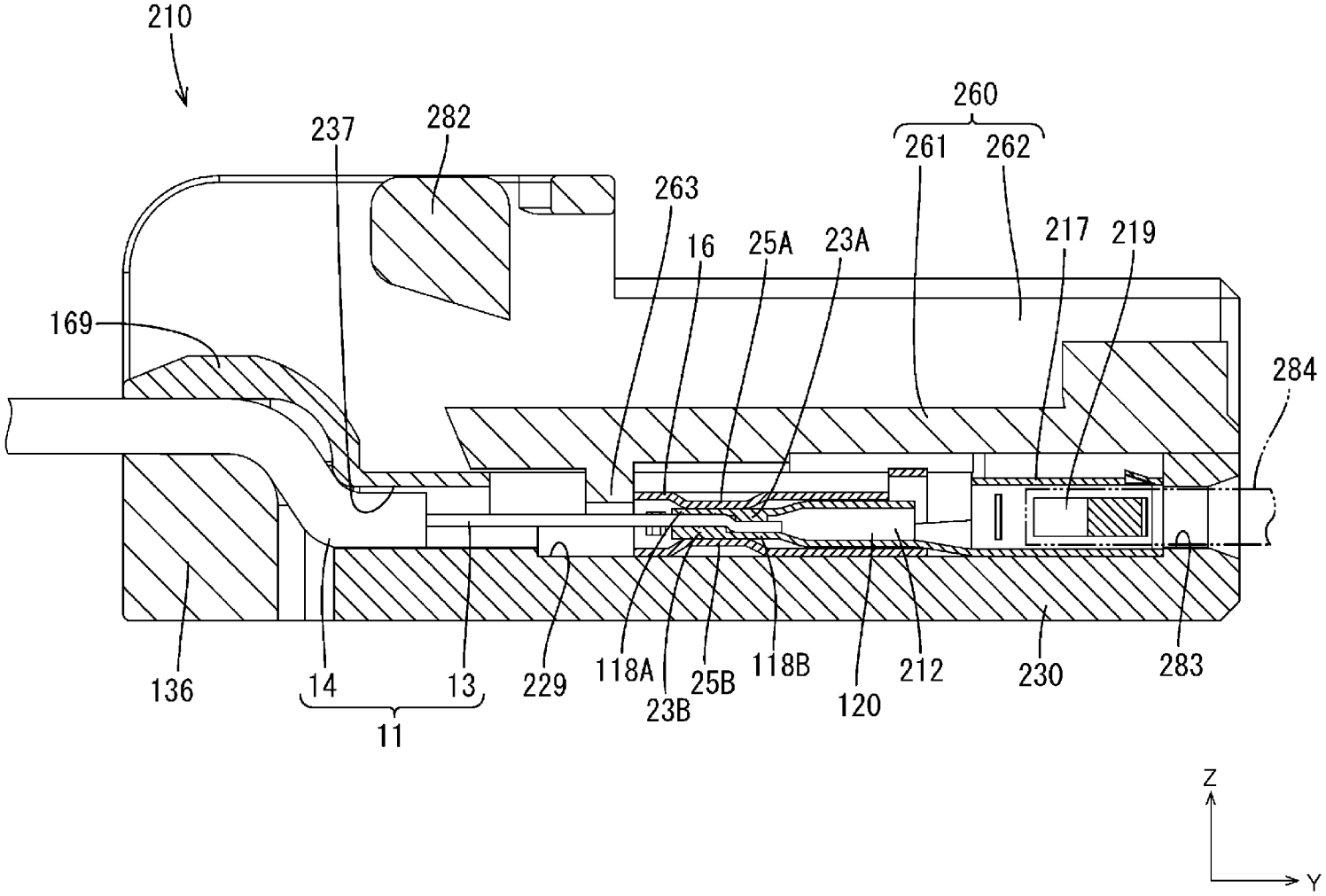
FIG. 27 is a side view in section showing the female connector.

As shown in FIG. 27, the lower housing 230 is made of an insulating synthetic resin, flat in a vertical direction and in the form of a rectangular parallelepiped extending in the front-rear direction. The lower housing 230 is formed with a plurality of (five in this embodiment) cavities 229 extending in the front-rear direction and configured to accommodate a plurality of (five in this embodiment) the female terminals 212. An insertion hole 283 open forward is formed in a frond end part of the cavity 229. A mating terminal 284 having a male tab shape is inserted into the insertion hole 283 from front.

A rear end part of each cavity 229 is open rearward and serves as a wire insertion hole 237, through which a wire 11 is inserted. A region of the cavity 229 except front and rear end parts is open upward.

[Upper Cover 260]

The upper cover 260 is made of insulating synthetic resin and includes an upper wall 261, side walls 262 extending upward and downward from both side edges of the upper wall 261, and a lock arm 280 extending rearward from a front end part of the upper wall 261.

A front end part of the lock arm 280 is integrally formed to a front end part of the upper cover 260. The lock arm 280 is formed to be deflectable and deformable in the vertical direction with the front end part thereof as a fulcrum. A rear end part of the lock arm 280 is formed with a grip portion 282 to be gripped by a worker. A connector lock portion 281 projecting upward is formed near a center in the front-rear direction on the upper surface of the lock arm 280. By locking the connector lock portion 281 to an unillustrated male connector, the female connector 210 and the male connector are held in a connected state.

[Female Terminals 212]

The female terminal 212 includes a terminal body 215 and a slide portion 16 relatively slidable with respect to the terminal body 215.

The terminal body 215 includes a terminal connecting portion 217, into which the mating terminal 284 in the form of a male tab is insertable. The terminal connecting portion 217 has a tubular shape extending in the front-rear direction. A front end part of the terminal connecting portion 217 is open forward, and the mating terminal 284 is inserted thereinto from front. A resilient contact piece 219 projecting inward is formed on the inner wall of the terminal connecting portion 217. The resilient contact piece 219 is formed to be resiliently deformable. The mating terminal 284 inserted into the terminal connecting portion 217 is sandwiched between the resilient contact piece 219 and the inner wall of the terminal connecting portion 217, thereby being electrically connected to the female terminal 212. A wire connecting portion 120 to be connected to the wire 11 is provided behind the terminal connecting portion 217.

Since the other configuration is substantially the same as in the second embodiment, the same members are denoted by the same reference signs and repeated description is omitted.

[Assembling Process of Female Connector Female Terminal]

Next, an example of an assembling process of the female connector 210 according to this embodiment is described. The assembling process of the female connector is not limited to the one described below.

The terminals 112 having the slide portions 16 partially locked are accommodated into the cavities 229 of the lower housing 230. The upper cover 260 is mounted at a temporary closing position for closing a part of the upper surface of the lower housing 230 (see FIG. 29).

Figure 28:
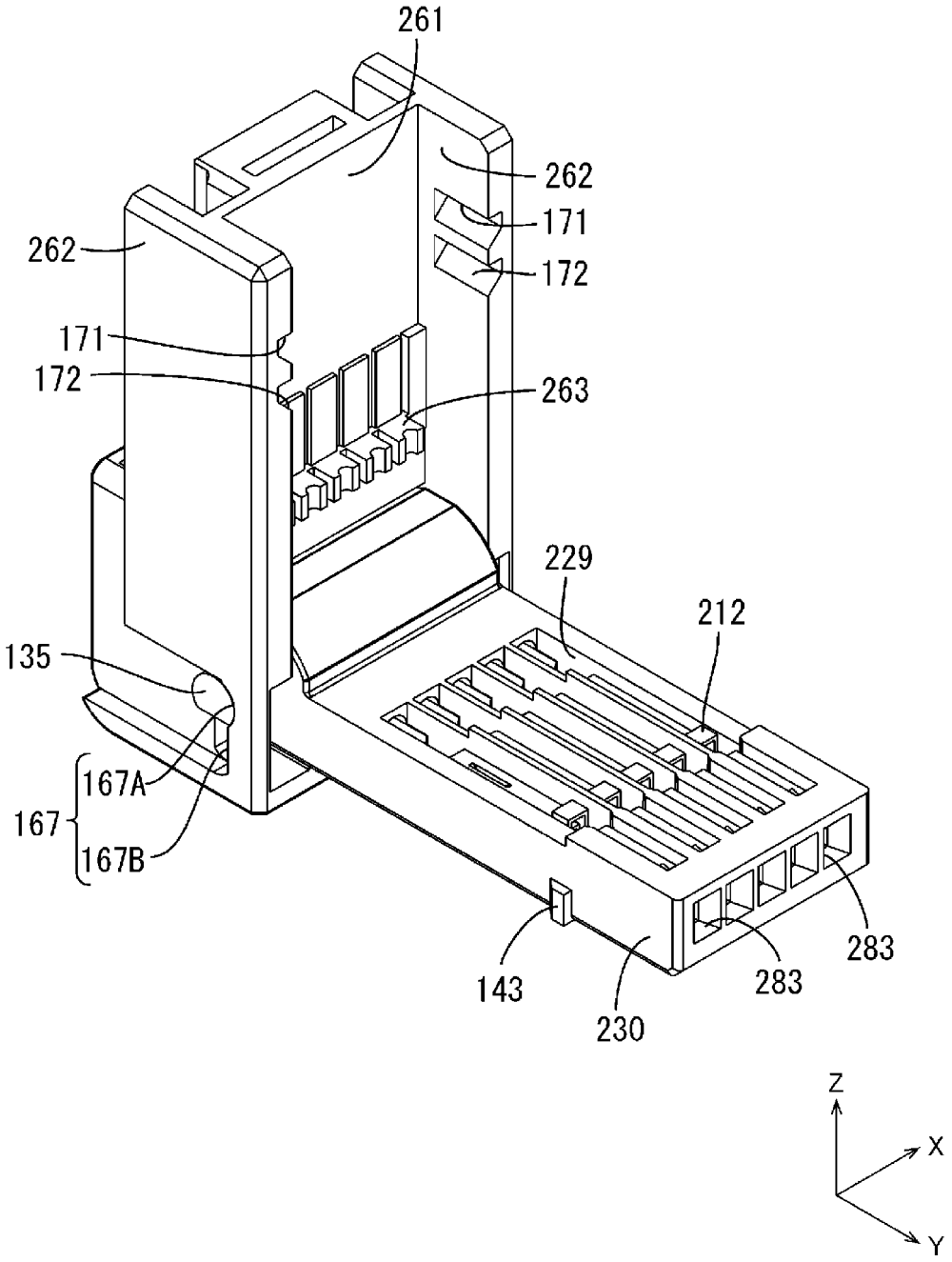
FIG. 28 is a perspective view showing a state where an upper cover is assembled at an opening position.

As shown in FIG. 28, the upper cover 260 is rotated to an opening position. The stripped wire 11 is inserted into the wire insertion hole 237 from behind. Subsequently, the slide portion 16 is pushed forward and moved to a full locking position. In this way, the core 13 and the female terminal 212 are electrically connected.

Figure 29:
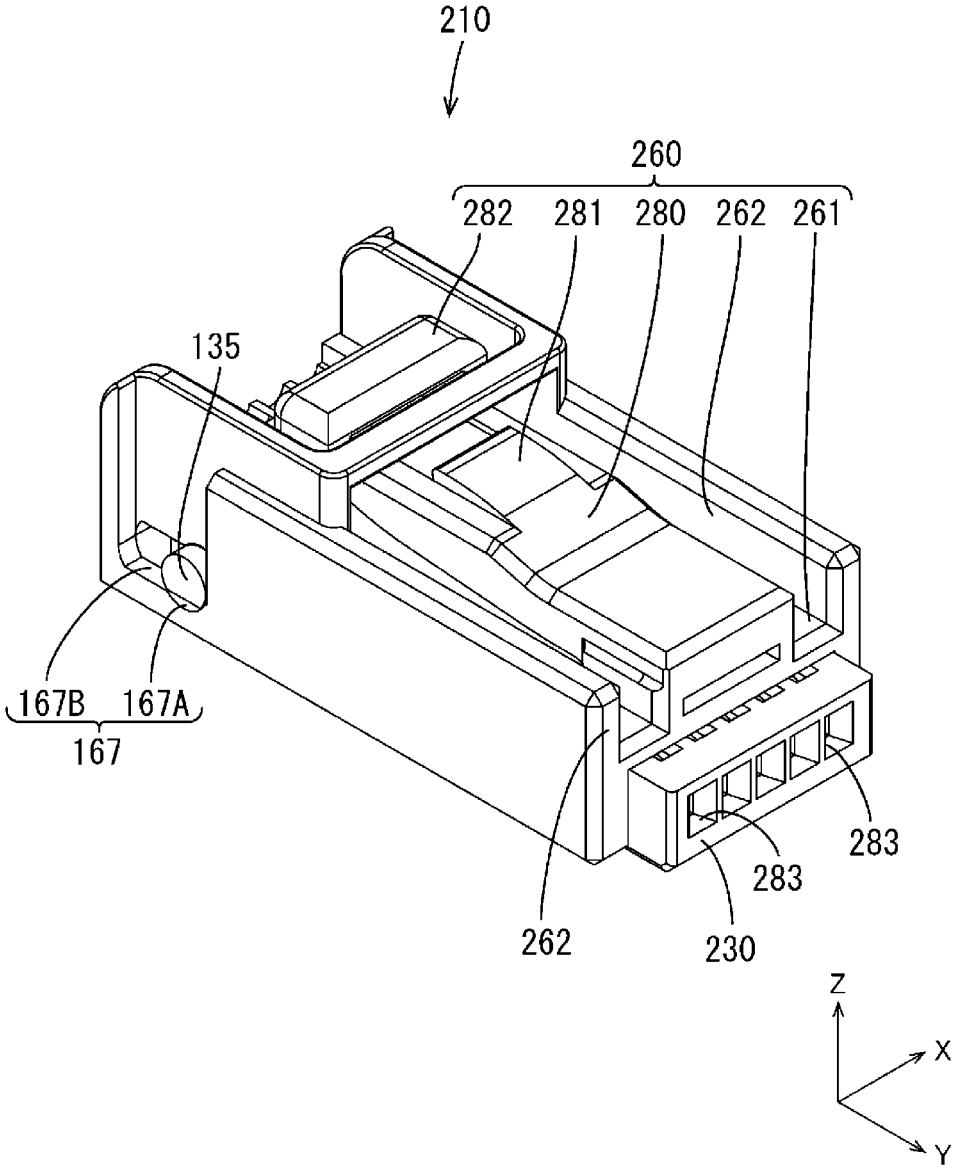
FIG. 29 is a perspective view showing a state where the upper cover is assembled at a temporary closing position.

As shown in FIG. 29, the upper cover 260 is rotated with respect to the lower housing 230 and assembled at the temporary closing position.

As shown in FIG. 26, the upper cover 260 is moved forward and assembled at the closing position with the lower housing 230. As shown in FIG. 27, the wires 11 are held in a bent state by being sandwiched by a lower guide portion 136 and an upper guide portion 169. In this way, the female connector 210 is completed.

[Functions and Effects of Embodiment]

According to this embodiment, the lower housing 230 includes the insertion holes 283, into which the mating terminals 284 are inserted, in a part where the female terminals 212 are to be disposed. Thus, the present disclosure can be applied to the female connector 210.

Other Embodiments (1) The terminal may include a crimping portion to be crimped to the outer periphery of the wire.

(2) The connector may be a joint connector for connecting two, three, five or more wires, a male connector including so-called male tabs, or a connector having an arbitrary shape.

(3) An arbitrary shape such as a rib shape, a groove shape or a hook shape can be selected as the shape of the wire positioning portion as long as the wire positioning portion positions the wire 11 by contacting the wire 11.

(4) The shaft hole 167 according to the second embodiment may be a long hole extending in the front-rear direction with the upper cover 160 rotated to the temporary closing position or may have any arbitrary shape.

(5) Although the lower housing includes the insertion holes in the female connector according to the third embodiment, there is no limitation to this and the upper cover may include insertion holes. The female connector may include one to four, six or more female terminals.

LIST OF REFERENCE NUMERALS

10: joint connector (example of connector)
11: wire
12: terminal
13: core
14: insulation coating
15: terminal body
16: slide portion
17: tube portion (example of busbar connecting portion)
18A: upper sandwiching portion
18B: lower sandwiching portion
20: wire connecting portion
23A: upper holding protrusion
23B: lower holding protrusion
25A: upper pressurizing portion
25B: lower pressurizing portion
26: partial lock receiving portion
27: full lock receiving portion
28: locking projection
29: cavity
30: lower housing
31: partition wall
32: busbar placing portion
33: lock receiving portion
34: locking claw
35: shaft portion
36: lower guide portion
37: wire insertion hole (example of wire positioning portion)
38: lower contact portion
45: jig
46: jig contact portion
47: guiding portion
50: busbar
52: tab
53: relay portion
54: coupling portion
59: clearance
60: upper cover
61: upper wall
63: terminal engaging portion
63F: front terminal engaging portion
63R: rear terminal engaging portion
64: busbar holding portion
66: lock claw (example of lock portion)
67: shaft hole
68: opening
69: upper guide portion
70: upper contact portion
110: joint connector
112: terminal
118A: upper sandwiching portion
118B: lower sandwiching portion
120: wire connecting portion
125A: upper pressurizing portion
125B: lower pressurizing portion
130: lower housing
135: shaft portion
136: lower guide portion
137: wire insertion hole (example of wire positioning portion)
140: flat surface
141: slide guide portion
142: narrow portion
143: slide lock portion
144: terminal locking portion
153: extending portion
154: coupling portion
155: bent portion
156: end part

160: upper cover
166: lock claw
167: shaft hole
167A: rotating portion
167B: extending portion
169: upper guide portion
171: cut portion
172: slide lock receiving portion
210: female connector (example of connector)
212: female terminal (example of terminal)
215: terminal body
217: terminal connecting portion
219: resilient contact piece
229: cavity
230: lower housing
237: wire insertion hole
260: upper cover
261: upper wall
262: side wall
280: lock arm
281: connector lock portion
282: grip portion
283: insertion hole
284: mating terminal

What is claimed is:

1. A connector to be connected to wires, comprising:
a lower housing; and
an upper cover,
wherein:
the lower housing accommodates terminals to be respectively connected to front end parts of the wires in an extending direction of the wires,
the upper cover is assembled to close an upper surface of the lower housing,
the lower housing or the upper cover includes a guide portion for bending the wires by contacting the wires with the lower housing and the upper cover assembled,
the upper cover includes terminal engaging portions to be engaged with the terminals with the upper cover assembled with the lower housing,
the terminal includes a wire connecting portion to be connected to the wire and a slide portion,
each wire connecting portion includes a sandwiching portion extending along the extending direction and configured to sandwich the wire,
the slide portion is disposed outside the sandwiching portion and movable along the extending direction between a full locking position and a partial locking position different from the full locking position,
the slide portion includes a pressurizing portion for pressurizing the sandwiching portion toward the wire with the wire sandwiched by the sandwiching portion when the slide portion moves to the full locking position, and
the terminal engaging portions are engaged with the terminals having the slide portions disposed at the full locking position.

2. The connector of claim 1, wherein:
the upper cover is so assembled with the lower housing as to be rotatable between an opening position for opening the upper surface of the lower housing and a closing position for closing the upper surface of the lower housing, and
the guide portion contacts and bends the wires at the closing position.

3. The connector of claim 2, wherein the upper cover is so assembled with the lower housing as to be movable along the extending direction between a temporary closing position for closing a part of the upper surface of the lower housing and the closing position.

4. The connector of claim 3, wherein:
one of the upper cover and the lower housing includes a shaft portion projecting toward the other and the other includes a shaft hole to be engaged with the shaft portion,
the shaft hole includes a rotating portion to be relatively rotatably engaged with the shaft portion and an extending portion extending from the rotating portion, and
the extending portion extends along the extending direction with the upper cover disposed at the temporary closing position with respect to the lower housing.

5. The connector of claim 2, wherein:
a lock portion provided on one of the upper cover and the lower housing is locked to the other of the upper cover and the lower housing, whereby the upper cover is assembled at the closing position with the lower housing,
the guide portion is provided near an axis of rotation, the upper cover rotating about the axis of rotation with respect to the lower housing, and
the lock portion is provided at a position distant from the axis of rotation.

6. The connector of claim 2, wherein:
the guide portion includes a lower guide portion provided on the lower housing and an upper guide portion provided on the upper cover, and
an upper surface of the lower guide portion has a shape along a trajectory of the upper cover moving between the opening position and the closing position.

7. The connector of claim 1, wherein:
the guide portion includes a lower guide portion provided on the lower housing and an upper guide portion provided on the upper cover,
the lower guide portion includes a lower contact portion for bending the wires by contacting the wires, and
the upper guide portion includes an upper contact portion for bending the wires by contacting the wires.

8. The connector of claim 1, wherein the lower housing includes a positioning portion for positioning the wires by contacting the wires.

9. The connector of claim 1, comprising a busbar to be connected to a plurality of the terminals, wherein:
the busbar includes a plurality of tabs and a coupling portion coupling the plurality of tabs, and
each of the plurality of terminals includes a busbar connecting portion to be connected to one of the plurality of tabs, the sandwiching portion and the slide portion.

10. The connector of claim 1, wherein the upper cover or the lower housing includes insertion holes in a part where the terminals are to be disposed, mating terminals being inserted into the insertion holes.

* * * * *